US011364502B2

(12) United States Patent
Meldrum et al.

(10) Patent No.: US 11,364,502 B2
(45) Date of Patent: Jun. 21, 2022

(54) DEVICE AND METHOD FOR HIGH-THROUGHPUT MULTIPARAMETER MEASUREMENTS IN ONE OR MORE LIVE AND FIXED CELLS

(71) Applicant: ARIZONA BOARD OF REGENTS ON BEHALF OF ARIZONA STATE UNIVERSITY, Scottsdale, AZ (US)

(72) Inventors: Deirdre Meldrum, Phoenix, AZ (US); Laimonas Kelbauskas, Gilbert, AZ (US); Wacey Teller, Mesa, AZ (US); Meryl Rodrigues, Tempe, AZ (US); Hong Wang, Tempe, AZ (US); Ganquan Song, Mesa, AZ (US); Yanqing Tian, Tempe, AZ (US); Fengyu Su, Tempe, AZ (US); Xiangxing Kong, Tempe, AZ (US); Liqiang Zhang, Chandler, AZ (US)

(73) Assignee: Arizona Board of Regents on Behalf of Arizona State University, Scottsdale, AZ (US)

( * ) Notice: Subject to any disclaimer, the term of this patent is extended or adjusted under 35 U.S.C. 154(b) by 414 days.

(21) Appl. No.: 15/774,558

(22) PCT Filed: Nov. 14, 2016

(86) PCT No.: PCT/US2016/061819
§ 371 (c)(1),
(2) Date: May 8, 2018

(87) PCT Pub. No.: WO2017/083817
PCT Pub. Date: May 18, 2017

(65) Prior Publication Data

US 2020/0047182 A1 Feb. 13, 2020

Related U.S. Application Data

(60) Provisional application No. 62/255,193, filed on Nov. 13, 2015.

(51) Int. Cl.
*B01L 3/00* (2006.01)
*B01L 99/00* (2010.01)

(52) U.S. Cl.
CPC . *B01L 3/502761* (2013.01); *B01L 2200/0668* (2013.01); *B01L 2300/0663* (2013.01);
(Continued)

(58) Field of Classification Search
CPC ..... B01L 3/502761; B01L 2200/0668; B01L 2300/0663; B01L 2300/0816;
(Continued)

(56) References Cited

U.S. PATENT DOCUMENTS

2006/0128006 A1* 6/2006 Gerhardt ..... B01L 3/502761 435/287.1
2012/0231533 A1 9/2012 Holl et al.
(Continued)

FOREIGN PATENT DOCUMENTS

WO 2015118551 A1 8/2015

OTHER PUBLICATIONS

Song, G., et al., "Single Cell Metabolic Profiling Using Multiplexed, Photo-Patterned Fluorescence Sensor Arrays," 18th International Conference on Miniaturized Systems for Chemistry and Life Sciences, Oct. 26-30, 2014, San Antonio, Texas, USA, pp. 884-886.
(Continued)

*Primary Examiner* — Lydia Edwards
(74) *Attorney, Agent, or Firm* — Withrow & Terranova, P.L.L.C.; Vincent K. Gustafson

(57) ABSTRACT

A microfluidic device includes a first substrate including at least one microfluidic channel and a plurality of microwells, as well as a cooperating second substrate defining multiple split-walled cell trap structures that are registered with and disposed within the plurality of microwells. A method for
(Continued)

performing an assay includes flowing cells and a first aqueous medium into a plurality of microwells of a microfluidic device, wherein each microwell includes a cell trap structure configured to trap at least one cell. The method further comprises flowing a nonpolar fluid with low permeability for analytes of interest through a microfluidic channel to flush a portion of the first aqueous medium from the microfluidic channel while retaining another portion of the first aqueous medium and at least one cell within each microwell. Surface tension at a non-polar/polar medium interface prevents molecule exchange between interior and exterior portions of microwells.

20 Claims, 14 Drawing Sheets

(52) U.S. Cl.
CPC ..... *B01L 2300/0864* (2013.01); *B01L 2300/0893* (2013.01); *B01L 2300/18* (2013.01)

(58) Field of Classification Search
CPC ..... B01L 2300/0829; B01L 2300/0851; B01L 2300/0864; B01L 2300/087; B01L 2300/0893; B01L 2300/18; B01L 2300/1805; B01L 3/50; B01L 3/502746; B01L 3/502753; B01L 3/50853; F01D 11/003; F05D 2230/90; F05D 2240/11; F05D 2240/80
See application file for complete search history.

(56) References Cited

U.S. PATENT DOCUMENTS

| | | | |
|---|---|---|---|
| 2013/0078163 | A1 | 3/2013 | Chung et al. |
| 2014/0348706 | A1 | 11/2014 | Rahman |
| 2015/0018226 | A1 | 1/2015 | Hansen et al. |
| 2015/0087007 | A1 | 3/2015 | Meldrum et al. |
| 2015/0165436 | A1 | 6/2015 | Chapman et al. |

OTHER PUBLICATIONS

International Search Report and Written Opinion for International Patent Application No. PCT/US2016/061819, dated Jan. 30, 2017, 7 pages.
International Preliminary Report on Patentability for International Patent Application No. PCT/US2016/061819, dated May 24, 2018, 7 pages.
Partial Supplementary European Search Report for European Patent Application No. 16865199.0, dated Jun. 7, 2019, 14 pages.
Extended European Search Report for European Patent Application No. 16865199.0, dated Sep. 9, 2019, 11 pages.

* cited by examiner

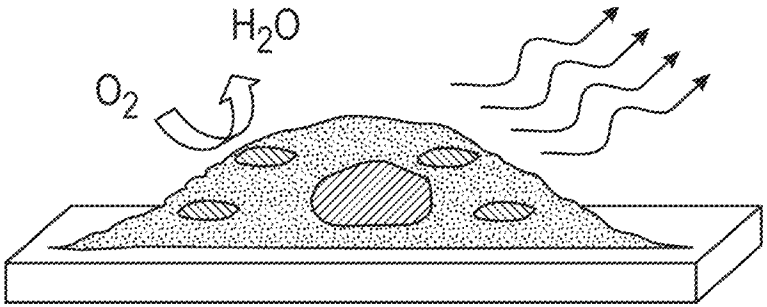

Real-Time Measurements

1. $O_2$ Uptake (Respiration Rate)
   --Mitochondrial Function
   --Activity/Latency
   --Screen Metabolic Capabilities
2. Multiwavelength Fluorescence
   --Membrane Potential
   --Membrane Integrity
   --Ion Gradients
   --Substrate Utilization
   --DNA Content
   --Surface Markers

*FIG._1A*

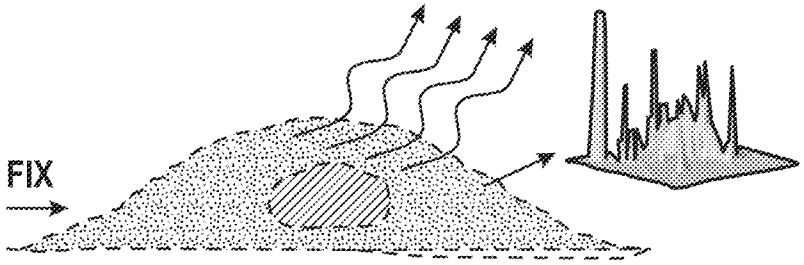

Post-Fixation Measurements

3. qRT- and Late PCR
   --Expression of Targeted Genes
   --Loss of Heterozygosity (LOH)
   --Gene Copy Number Alterations
4. Single Cell Transcriptomics
   --Global Gene Expression
   --Quantify Hypoxia Response Genes
5. Single Cell Proteomics
   --Proteomics Fingerprints
   --Link Between Protein Profiles
   & Cell Death/Life

*FIG._1B*

DEVICE AND METHOD FOR HIGH-THROUGHPUT MULTIPARAMETER MEASUREMENTS IN ONE OR MORE LIVE AND FIXED CELLS

STATEMENT OF RELATED APPLICATION(S)

This application is a 35 U.S.C. § 371 national phase filing of International Application No. PCT/US2016/061819 filed Nov. 14, 2016, and claims the benefit of U.S. Provisional Patent Application No. 62/255,193 filed Nov. 13, 2015, wherein the disclosures of the foregoing applications are hereby incorporated by reference herein in their entireties.

GOVERNMENT RIGHTS IN INVENTION

This invention was made with government support under P50 HG002360 and U01 CA164250 awarded by the National Institutes of Health. The government has certain rights in the invention.

TECHNICAL FIELD

The disclosure describes devices and methods useful for identifying small populations or individual rare cells with abnormal function and/or response to stress that are responsible for pathogenesis and disease recurrence. As a means for multi-parameter multiplexed analysis of transmembrane fluxes and cell state in general, devices and methods disclosed herein can be utilized in clinical, pharmacological, and research settings for one or more of the following applications: research involving measurements of metabolism, gene expression, protein expression, DNA sequencing, and the like; cell-cell interaction experiments; stimulus-response experiments in which the stimulus includes environmental changes, infection, perturbagens, drugs, genomic alterations, and the like; drug response studies (e.g., pharmacokinetics); early disease detection and screening; risk assessment for disease progression (e.g., premalignant to malignant progression in cancer); therapeutic target identification and validation; biosignature development and validation; and stress-response studies.

BACKGROUND

The field of single-cell analysis has experienced tremendous growth over the last decade in both technological advancements and research focus. The notion of cellular heterogeneity and its central role in many, if not all, diseases including cancer have been established and widely accepted by the research community. Concurrently, technological advances toward developing analytical methods and platforms capable of capturing and analyzing signals at the single-cell level have enabled insights into cellular function in unprecedented detail. Technological developments have enabled analysis of genome, transcriptome, and proteome with single cell resolution at the systems level. Imaging-based high-throughput/high-content (HT/HC) screening platforms are widely used for multi-parameter drug screening and therapeutic target identification in research and clinical settings. Although these platforms can generate single-cell data, they are limited to analyses of intracellular parameters or cell surface markers. Transmembrane fluxes (TF) of small molecules and cellular products, on the other hand, represent a class of functional readouts that are highly sensitive, fast-responding, and specific to alterations in the cellular state. TFs can be used for determining changes in cellular homeostasis in response to a broad spectrum of perturbations, such as in drug screening applications, early disease detection, or infection. Measuring TFs at the individual cell level (and for small populations of cells) represents a formidable challenge owing to inherently small (~femtomoles/minute) changes in analyte amounts induced by single cells and the difficulty to attribute those changes to a particular cell in a cell population. More importantly, single cell analysis deals with noisy data due to intrinsic cellular variability. As a result, to obtain most information-rich data from this type of analysis, it is necessary to compare cellular states of the same cells before and after perturbation. However, all currently available single-cell analysis technologies are either destructive and offer only end-point analyses (e.g., single-cell DNA-seq, RNA-seq, proteomic analysis), or are not suited for measuring TFs (e.g., involving imaging-based HT/HC analyses).

Current technologies for single cell analysis may be low-throughput, provide destructive end-point analyses, or both. Moreover, the implementation of existing single-cell analysis approaches is complex, requires multiple steps of sample preparation, and is limited in the types of analyses provided.

Conventional single-cell analysis technologies are limited to measurements of intracellular parameters such as morphology, growth rate, and membrane potential. Transmembrane fluxes of a cell represent a class of crucially important functional parameters that are extremely sensitive to alterations in the cellular state. As of the effective date of this application, the inventors are not aware of any available technologies for multiplexed measurement of transmembrane fluxes in live individual cells with high throughput and high content.

SUMMARY

This disclosure describes a method and device for multiplexed measurements of TFs and other parameters in individual cells with high throughput and high efficiency. The method also applies to small populations of cells. A microfluidic device enables rapid assessment of a cellular state (or states) of one or more cells per well by measuring TFs and a combination of other established intracellular or cell surface markers before, during, and after one or more perturbations, including, but not limited to, exposure to at least one therapeutic drug or drug candidate. A working principle of a microfluidic device is based on the measurement of changes in analyte concentrations within a hermetically sealed (e.g., fluid-sealed) microwell (also referred to throughout as simply "well") containing at least one live cell. One aspect of the disclosure utilizes surface tension at the non-polar/polar medium (e.g. oil/aqueous cell culture media) interface for preventing molecule exchange between the interior and exterior of microwells that contain at least one cell (e.g., one cell per well or a small population of cells per well) and optionally include one or more intra-well or extra-well (e.g., optical) sensors. Another aspect of the disclosure encompasses a specific microwell design that enables both rapid exchange between oil and cell growth medium in the volume surrounding the wells, and allows introduction of perturbagens into the wells. The method of isolating and/or sealing single cells in wells enables scaling up to high throughput applications offering throughputs from thousands to potentially millions of individual cells per assay. Due to the relative simplicity and ease of implementation, the device may be used for HT/HC screening and analysis applications with single cell resolution in both clinical and research settings. It may also be used for cell-cell interaction studies with small populations of cells in each well.

In one aspect, the disclosure relates to a microfluidic device including a first substrate and a second substrate configured to be assembled with one another. The first substrate defines at least one microfluidic channel and a plurality of microwells. The second substrate defines a plurality of split-walled cell trap structures that is registered with and disposed within the plurality of microwells. In certain embodiments, the microfluidic device may consist of or comprise a microfluidic chip.

In certain embodiments, a gap is provided between the first substrate and the second substrate along a lip of each microwell of the plurality of microwells.

In certain embodiments, each cell trap structure of the plurality of split-walled cell trap structures comprises an open upstream end sized to receive at least one cell, and comprises a downstream opening configured to inhibit passage of at least one cell while permitting passage of an aqueous medium. In certain embodiments, the at least one microfluidic channel comprises an increased lateral dimension proximate to each microwell of the plurality of microwells.

In certain embodiments, a microfluidic device further includes a media inlet port, a secondary fluid inlet port, and an outlet port in fluid communication with the at least one microfluidic channel. In certain embodiments, the at least one microfluidic channel comprises a plurality of microfluidic channels arranged in parallel, the plurality of microwells includes multiple groups of microwells, and each microfluidic channel of the plurality of microfluidic channels interconnects a different group of microwells of the multiple groups of microwells.

In certain embodiments, the open upstream end of each cell trap structure defines an opening having a width in a range of from about 10 microns to about 30 microns.

In certain embodiments, a plurality of sensors is provided in sensory communication with the plurality of microwells. In certain embodiments, the plurality of sensors may be arranged within, and/or arranged external to, the plurality of microwells.

In certain embodiments, the microfluidic device further includes at least one heating or cooling element arranged to control temperature of the microfluidic device.

In certain embodiments, the microfluidic device comprises at least 100 microwells, at least 1000, or at least 10,000 microwells.

This present disclosure also describes a method and integrated device for high throughput dynamic multiplexed measurements of transmembrane fluxes of analytes combined with a variety of other extracellular and intracellular parameters in individual live cells, with at least one cell per well. The device enables studies of cellular function dynamics under normal conditions and in response to changes in environmental conditions, e.g. presence of a drug in the medium, on the same individual cells. The method is based on rapid hermetic sealing and un-sealing of sub-nanoliter microwells containing single cells, small populations of cells, multi-cellular clusters, or small tissue samples using a non-polar fluid with low permeability (e.g., mineral oil) that acts as a barrier preventing the exchange of analyte molecules with the exterior of the well. The ability to rapidly replace oil with a cell culture media and vice versa enables the following benefits: 1) a repeated and fast (within seconds) change from culturing to measurement conditions for time-lapse studies; 2) the ability to introduce and analyze cellular function in response to various compounds (drugs, perturbagens, etc.) on the same individual cells, small populations of cells, multi-cellular clusters, or small tissue samples; 3) scale-up capability from thousands to millions of individual cells or cell groups/clusters per assay; and 4) compatibility with high resolution imaging. In certain embodiments, wells contain a gap between the lip of the well and the second (e.g., bottom) substrate.

Certain aspects of the disclosure relate to a method and device for high throughput multi-parameter functional analysis of cellular states with single cell resolution. The approach enables a variety of functional assays to be performed in single live and fixed cells including transmembrane flux measurements of different analytes on the same individual live cells, which can then be analyzed using analyses such as gene expression, protein expression and genome analyses. In certain embodiments, such analyses may be performed in situ on one or more cells in the well in the same device used for transmembrane flux measurements. In other embodiments, such analyses may be performed in one or more downstream devices and/or instruments. The method is compatible with small clinical samples (several hundreds of cells per assay) and can be applied for drug screening, therapeutic target discovery applications, early detection and diagnosis of disease, rapid screening of disease progression, and prognostic studies. The device is low-cost, simple to use, and can be implemented in any clinical or research setting.

In another aspect, the present disclosure relates to a method for performing an assay using cells, in at least one of isolation, small populations, multicellular clusters, or small tissue samples. The method comprises flowing cells, small populations, multi-cellular clusters, or small tissue samples, and flowing a first aqueous medium into a microfluidic device comprising a microfluidic channel interconnecting a plurality of microwells, wherein each microwell of the plurality of microwells contains a cell trap structure configured to trap at least one cell, thereby causing each cell trap structure to trap at least one cell. The method further comprises flowing a non-polar fluid with low permeability for analytes of interest through the microfluidic channel to flush a portion of the first aqueous medium from the microfluidic channel while retaining another portion of the first aqueous medium as well as the at least one cell within each microwell of the plurality of microwells. In certain embodiments, the method further includes flowing a second aqueous medium through the microfluidic channel to flush the non-polar fluid from the plurality of microwells and to flush the other portion of the first aqueous medium from each cell trap structure while retaining the at least one cell within each cell trap structure.

In certain embodiments, the method further comprises incubating the at least one cell within each microwell of the plurality of microwells.

In certain embodiments, the method further comprises sensing concentration of at least one analyte for the at least one cell trapped in each cell trap structure.

In certain embodiments, the method further comprises analyzing cellular function of the at least one cell trapped in each cell trap structure. In certain embodiments, said analyzing of cellular function comprises measurement of transmembrane flux and a combination of other intracellular or cell surface markers before, during, and after one or more perturbations, wherein the one or more perturbations optionally include exposure to at least one therapeutic drug or drug candidate.

In certain embodiments, the at least one cell trapped in each cell trap structure comprises a multi-cell cluster or tissue sample.

In certain embodiments, the method further comprises fabricating the microfluidic device by contacting a first substrate defining at least one microfluidic channel and the plurality of microwells with a second substrate defining a plurality of split-walled cell trap structures, wherein the plurality of split-walled cell trap structures is registered with and disposed within the plurality of microwells.

In certain embodiments, the method further comprises introducing cell lysis buffer and one-step RT-qPCR mixture to each microwell of the plurality of microwells to release cellular contents of cells within the plurality of microwells.

In certain embodiments, the method further comprises performing RT-qPCR analysis of cells within the microfluidic device while the cells remain in the plurality of microwells.

In certain embodiments, the method further comprises flowing one or more reagents into each microwell of the plurality of microwells and analyzing cells within the microfluidic device while the cells remain in the plurality of microwells. In certain embodiments, the analyzing further comprises at least one of RNA analysis, DNA analysis, or protein analysis.

Methods and devices for creating hermetically sealed chambers using a fluidic seal not only enable high throughput assays, but also provide means for rapid removal of the seal and introduction of perturbagens to cells. In this way, controls and assays could be run sequentially on the same individual cells. Additionally, end-point analyses such as gene expression and protein expression level measurements can be run on the same chip with the same individual cells. The approach lends itself to high throughput applications as it is easily scalable and not limited by the amount and highly uniform distribution of pressure across the substrate that represent formidable challenges at the micro scale, but are necessary to produce hermetic seals. The same experiments can be performed on small populations of cells in each well.

Other aspects and embodiments will be apparent from the detailed description and accompanying drawings.

BRIEF DESCRIPTION OF THE DRAWINGS

The accompanying drawings incorporated in and forming a part of this specification illustrate several aspects of the disclosure, and together with the description serve to explain the principles of the disclosure.

FIGS. 1A and 1B provide perspective view schematic illustration and textual overviews of types of analyses (including multi-parameter real-time measurements in FIG. 1A and post-fixation measurements in FIG. 1B) compatible with the disclosed single-cell analysis approach.

DETAILED DESCRIPTION

Figure 2:
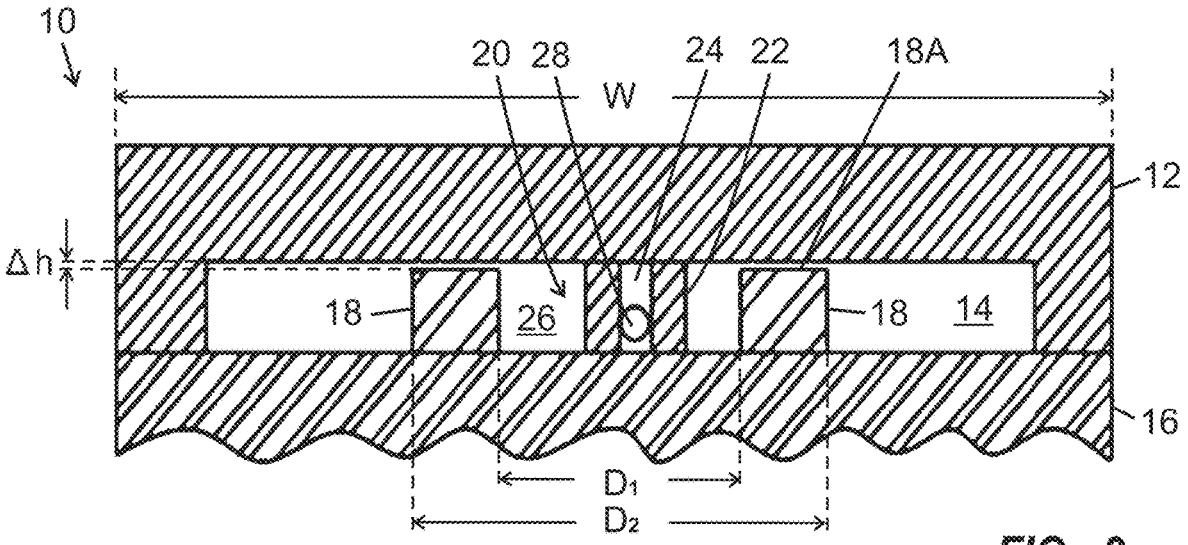
FIG. 2 is a side cross-sectional view schematic illustration of a portion of a microwell device for an oil-based sealing approach.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It should be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It should also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It should be understood that, although the terms "upper," "lower," "bottom," "intermediate," "middle," "top," and the like may be used herein to describe various elements, these elements should not be limited by these terms. These terms are only used to distinguish one element from another. For example, a first element could be termed an "upper" element and, similarly, a second element could be termed an "upper" element depending on the relative orientations of these elements, without departing from the scope of the present disclosure.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having meanings that are consistent with their meanings in the context of this specification and the relevant art and will not be interpreted in an idealized or overly formal sense unless expressly so defined herein.

The approach disclosed herein addresses low throughput limitations by facilitating highly-scalable, functional assays of individual cells, small cell populations, multi-cellular 3D clusters, and small biological tissue samples that can be combined with a broad range of other, existing single-cell analysis methods or enable performance of several end-point analyses on the same chip. Furthermore, sequential assays can be performed under different experimental conditions on the same individual cells, small cell populations, multi-cellular 3D clusters, or small biological tissue samples, which is a feature not believed to be offered by conventional single-cell technologies.

Aspects of the present disclosure relate to a method of producing microscale hermetic seals required for measurements of at least one cell (e.g., one cell per well or a small population of cells per well), utilizing a non-polar fluid with low permeability (e.g. mineral oil) as a diffusion barrier for molecules of interest. The non-polar fluid is immiscible with aqueous (polar) cell growth media, thereby facilitating displacement of cell growth media with oil, and vice-versa, without significant mixing at an interface of the two liquids.

In one aspect, the disclosure relates to a microfluidic device including a first substrate and a second substrate that are arranged to be assembled together. The first substrate defines at least one microfluidic channel and a plurality of microwells, and the second substrate defines a plurality of split-walled cell trap structures, wherein the plurality of split-walled cell trap structures is registered with and disposed within the plurality of microwells.

Various types of analyses compatible with the single cell analysis approach disclosed herein are identified in FIGS. 1A and 1B, including analyses capable of measuring multiple parameters including physiological, genomic, transcriptomic, and proteomic characteristics. FIG. 1A includes a schematic illustration of cellular material being subject to real-time measurements of oxygen uptake (or respiration rate) and being subject to multi-wavelength fluorescence to measure various parameters (e.g., membrane potential, membrane integrity, ion gradients, substrate utilization, DNA content, and surface markers). Oxygen uptake (or respiration rate) measurements may be used to assess mitochondrial function, assess cell activity/latency, and screen metabolic capabilities of cells. FIG. 1B includes a schematic illustration of cellular material of the same cells being subject to further measurements after fixation, such as qRT– and LATE PCR, single cell transcriptomics, and single cell proteomics. qRT– and LATE PCR may be used to identify or assess expression of targeted genes, loss of heterozygosity (LOH), and/or gene copy number alterations. Single cell transcriptomics may be used to identify or assess global gene expression and/or quantify response (e.g., hypoxia or low oxygen condition) genes. Single cell proteomics may be used to generate proteomics fingerprints and/or establish linkages between protein profiles and cell death or life.

Figure 3:
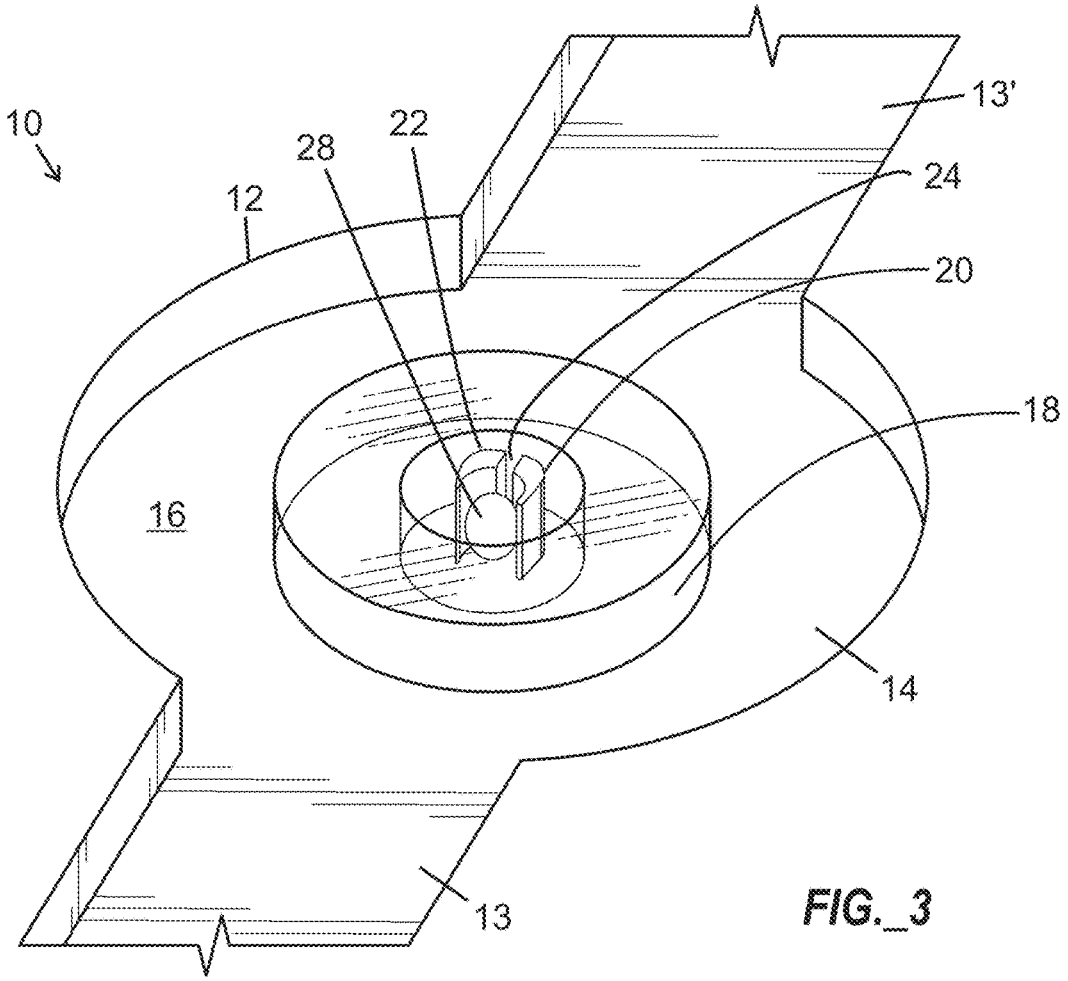
FIG. 3 is an upper perspective view schematic illustration of a portion of a microwell device for the oil-based sealing approach.

FIGS. 2 and 3 illustrate a portion of a microwell device forming a cell trap 10, with the microwell device portion including a bottom substrate part 16 (defining a microwell 26) and a top substrate part 12 (defining channels segments 13, 14, 13'), useful for an oil-based sealing approach for isolating single cells or small groups of cells. FIG. 2 is a side cross-sectional view schematic illustration and FIG. 3 is an upper perspective view schematic illustration of the microwell device portion. Referring to FIGS. 2 and 3, the bottom substrate part 16 defines a ring structure 18 forming a microwell (or simply "well") 26, and the top substrate part 12 contains a microfluidic upstream channel segment 13, a ring shaped microfluidic intermediate channel segment 14, and a microfluidic downstream channel segment 13' for receiving two different fluids. The ring structure 18 defining the microwell 26 includes an upper lip 18A that is arranged proximate to (but not in contact with) an overlying portion of the top substrate part 12. A split-wall, Pachinko-type trap structure 20 including a crescent-shaped split wall 22 forms a cell receiving compartment having an open upstream end and a reduced width downstream opening 24 to provide cell trapping utility. In certain embodiments, the ring structure 18 forming the well wall includes an outer diameter D2 of approximately 120 microns and includes an inner diameter D1 of approximately 70 microns, while the top substrate part 12 includes a width W of about 240 microns. As illustrated, a cell 28 is retained by the cell receiving compartment formed by the crescent-shaped spilt wall 22. Upon assembly, the novel design of the well 26 forms a gap between the ring structure 18 forming a wall of the well 26 and the top substrate part 12, with the gap having a height dimension Δh (e.g., approximately 2 microns in certain embodiments). In this way, the bottom substrate part 16 and the top substrate part 12 do not form a fully closed well 26. This gap plays two roles in the cell trap 10, namely: a) interaction between an aqueous solution, oil, and the top and bottom substrate parts 12, 16 is such that surface tension at the interface of the three materials prevents the oil from entering the well 26 when cell aqueous solution is present in the well 26; b) at the same time, the presence of the gap enables quick replacement of a cell medium inside the well 26 with another aqueous medium without the need for separating the top and bottom substrate parts 12, 16. The removal of the top substrate part 12 may cause damage to the cell 28 due to the fluidic shear stress produced in the well 26. The medium that replaces the oil may contain different types of biologically relevant perturbagens, adjusted pH levels, temperature, etc., thus allowing cellular perturbation response studies using the same cells. This represents a significant advantage over single cell analysis methods that do not allow repetitive measurements to be conducted on the same individual cells. Moreover, in a device utilizing multiple wells according to the design of FIGS. 2 and 3, the design enables reagents to be added to the wells for further experiments on the same cells in the same wells (e.g., gene expression, protein expression, etc.) while in the device and/or for the cells to be harvested and cultured for further studies.

Figure 4A:
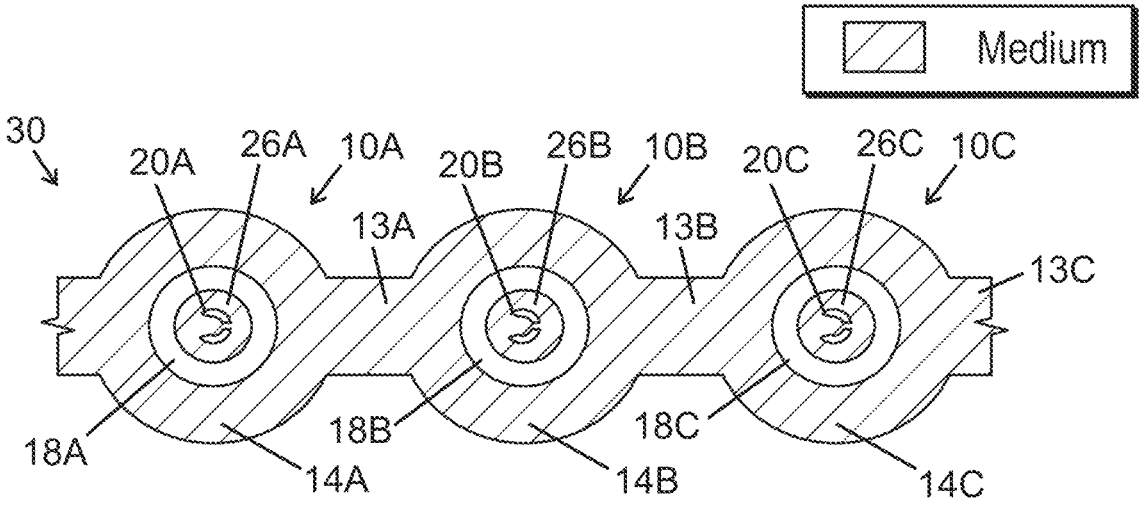
FIGS. 4A-4C embody top view schematic illustrations of three operating states of a microfluidic device including multiple wells each containing a cell trap, with the operating states including replacement of aqueous medium with oil, followed by replacement of oil with another aqueous medium.
Figure 4B:
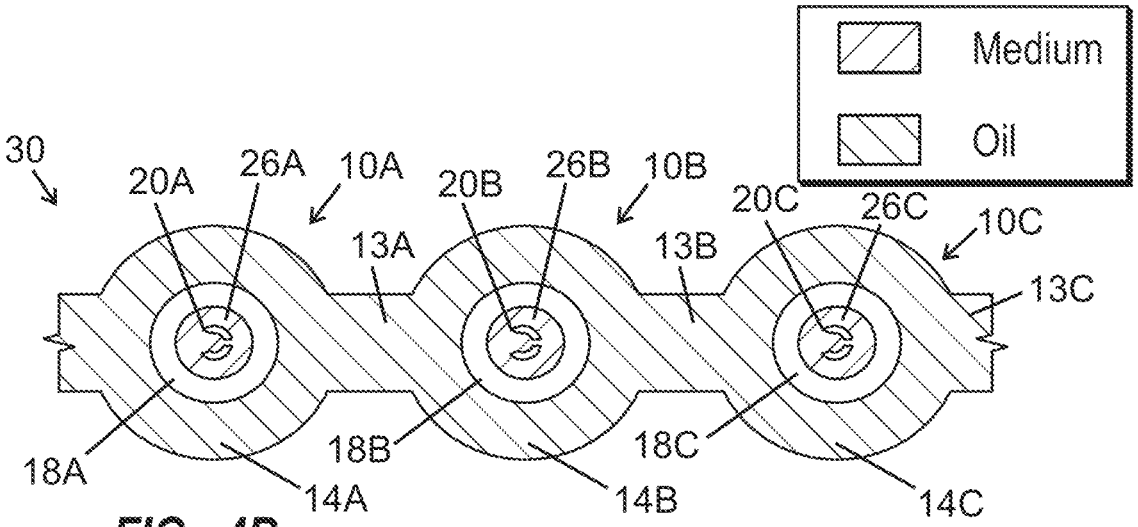
Figure 4C:
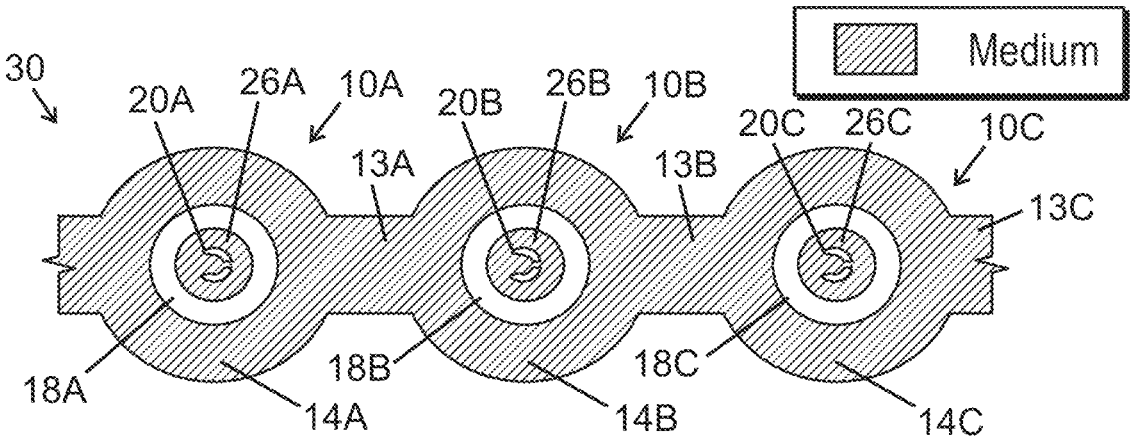

One implementation of a multi-well device is depicted in FIGS. 4A-4C, which embody top view schematic illustrations of three operating states of a portion of a microfluidic device that includes a group 30 of three cell traps 10A-10C interspersed in series with channel segments 13A-13C. Each cell trap 10A-10C includes a crescent-shaped split wall Pachinko-type trap structure 20A-20C arranged within a well 26A-26C defined by a ring structure 18A-18C that is surrounded by a ring-shaped intermediate microchannel segment 14A-14C. The crescent-shaped split wall Pachinko-type trap structures 20A-20C serve the purpose of trapping individual cells with high efficiency. Cell loading takes place prior to putting the well array onto the channel array by flowing a growth medium containing live cells through the channel segments 13A-13C, 14A-14C. The cell suspension is introduced into the channel segments 14A-14C containing the cell traps 10A-10C through an upstream inlet port (not shown). Cells passing through the channel segments are trapped in the split wall Pachinko-type trap structures 20A-20C randomly, while the trap design is such that it only allows for one cell to be caught per trap structure 20A-20C. Once a cell is present in a trap structure 20A-20C, the trap structure 20A-20C is occupied and inaccessible to other cells. The excess cells and medium are collected at a downstream outlet port (not shown) of a microfluidic chip. Proof-of-principle experiments have shown that the cell loading step takes 2-3 seconds and provides average occupancy levels of 80-90%.

FIG. 4A illustrates presence of a first aqueous medium in the channel segments 13A-13C, 14A-14C and wells 26A-26C of the cell traps 10A-10C. FIG. 4B illustrates replacement of the first aqueous medium with oil in the channel segments 13A-13C, 14A-14C and wells 26A-26C. FIG. 4C illustrates replacement of contents of the channel segments 13A-13C, 14A-14C and wells 26A-26C with a second aqueous medium.

Figure 4D:
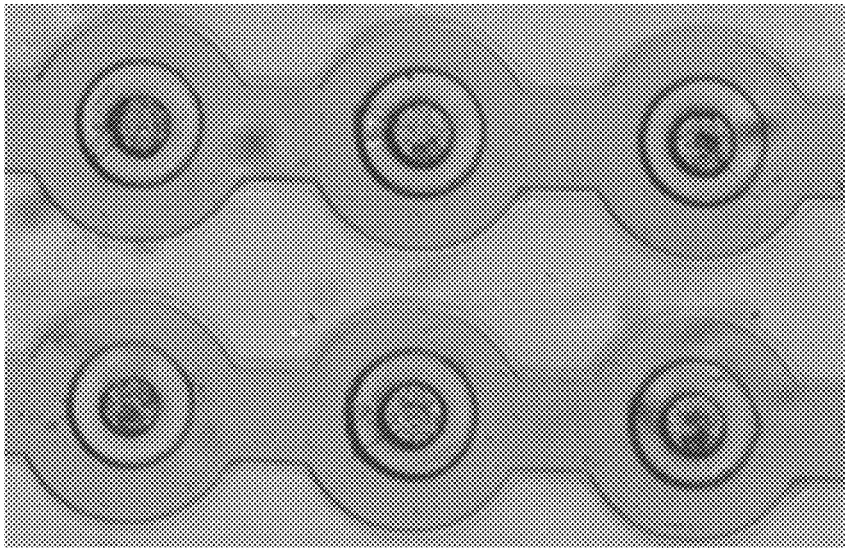
FIGS. 4D-4F embody top view photographs of a microfluidic device demonstrating the working principle of replacement of a first aqueous medium (green) with oil (red), followed by replacement of oil (red) with another aqueous medium (red), with FIG. 4F showing red colored water replacing red colored oil outside of each well and entering into the respective well to replace green colored water present from a first loading step.
Figure 4E:
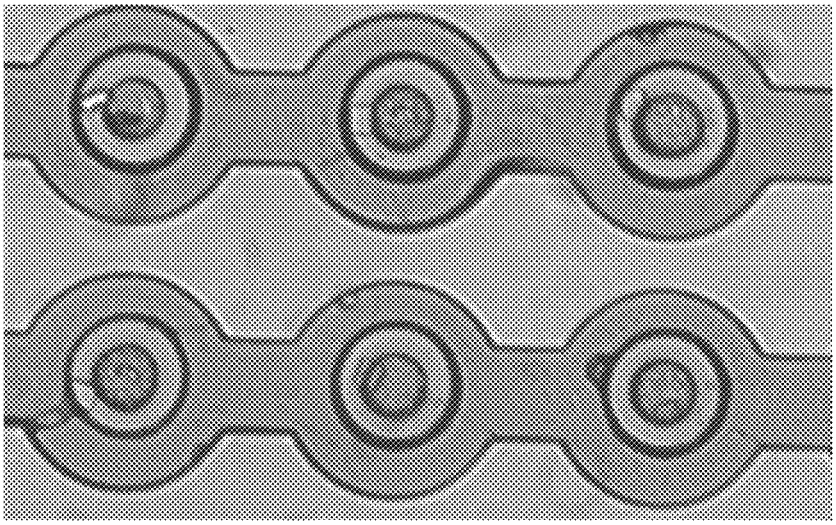
Figure 4F:
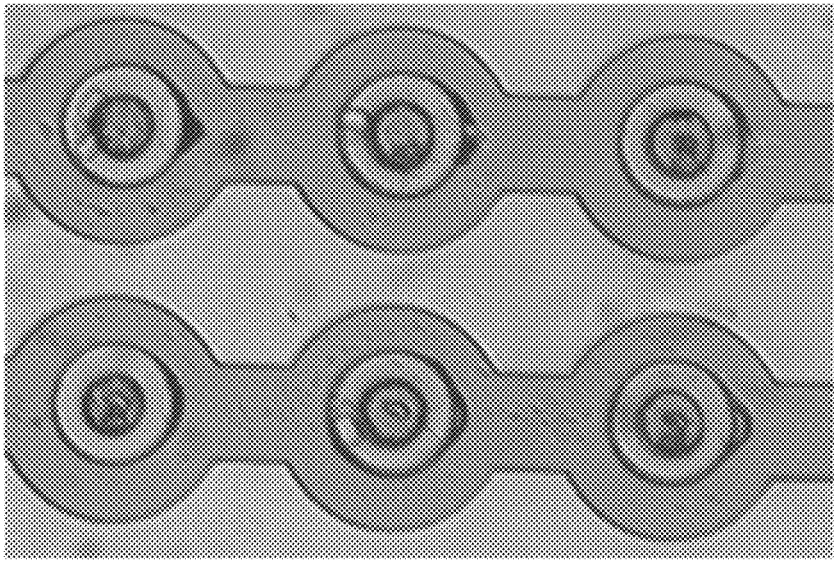

FIGS. 4D-4F embody top view photographs of a microfluidic device including two parallel groups 30A, 30B of three series-connected cell traps demonstrating the working principle of replacement of a first aqueous medium (green) contained in channel segments and wells (shown in FIG. 4D) with oil (red) in the channel segments (shown in FIG. 4E). Such step is followed by replacement of oil (red) in the channel segments with another aqueous medium (red), as shown in FIG. 4F, in which red colored water is shown as replacing red colored oil outside of each well and entering into each respective well to replace green colored water present in FIGS. 4D and 4E.

In certain embodiments, cells can be recirculated (i.e., flowed multiple times across or through a microfluidic chip) to increase the loading efficiency to 100%, which is of particular value for small samples such as liquid biopsies containing rare circulating tumor cells. The size of trap structures can be varied over a broad range to match the size of cells under study. In certain embodiments, trap structures of different sizes can be provided on the same microfluidic chip to capture cells of different sizes from highly heterogeneous samples (such as disaggregated clinical biopsy samples or murine tissue samples).

In certain embodiments, trap structures may be sized and configured to capture small multicellular clusters ranging from 50-300 μm in diameter or larger to enable cellular function studies in the context of complex multicellular structures and cell-cell interaction studies.

Figure 5A:
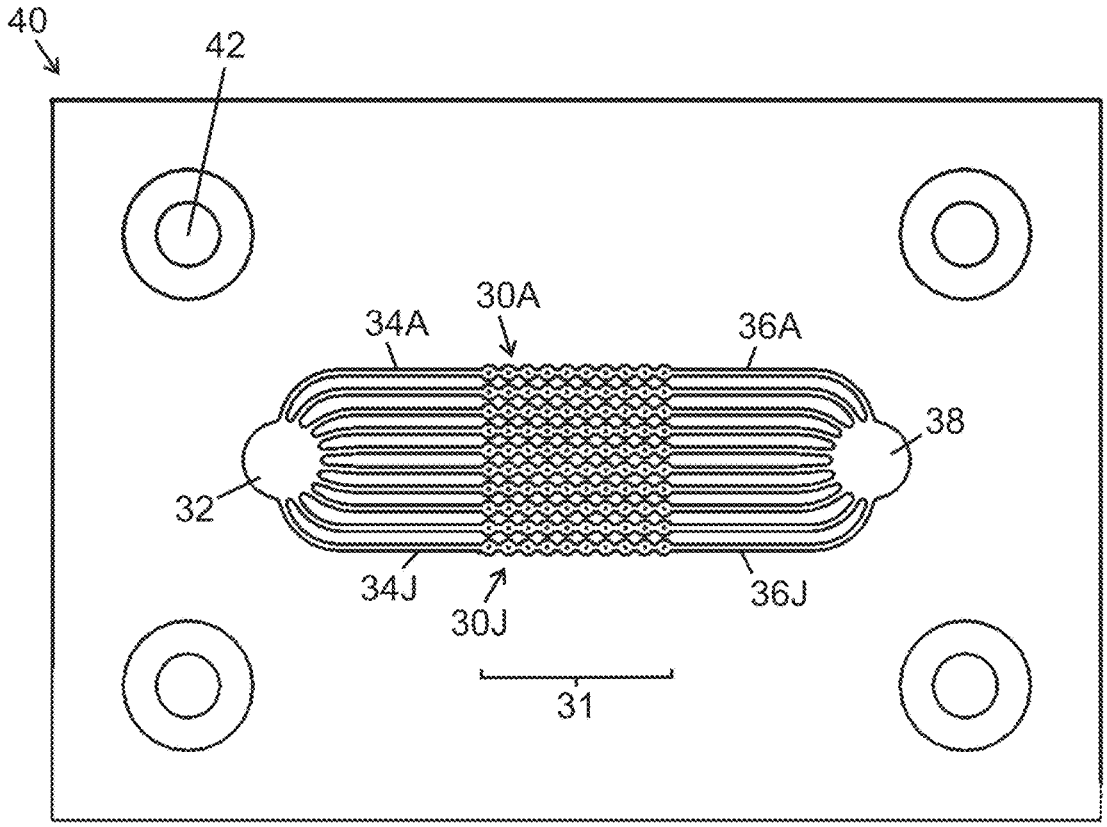
FIG. 5A is a top plan view illustration of a microfluidic chip including a 10×10 array of split-walled cell traps connected by channels for introduction of cell growth medium and oil.
Figure 5B:
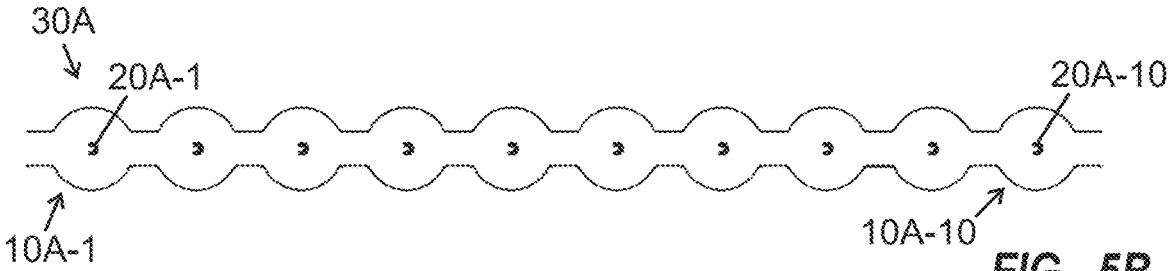
FIG. 5B is a magnified view of a first string or linear group of ten split-walled cell traps of FIG. 5A.
Figure 5C:
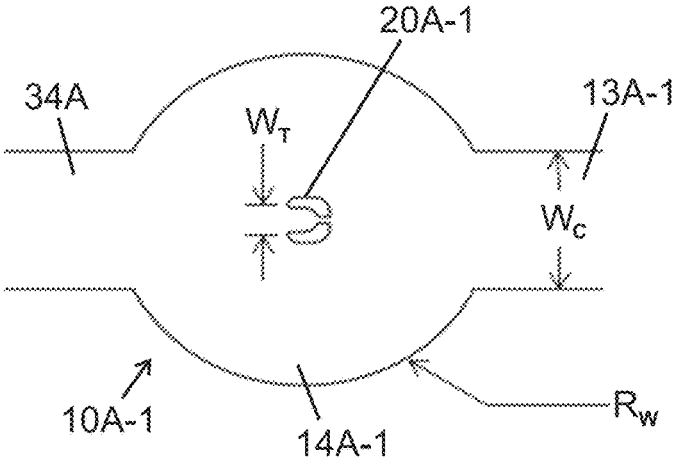
FIG. 5C is a further magnified view of a single split-walled cell trap of FIGS. 5A and 5B.

FIG. 5A is a top plan view illustration of a microfluidic chip 40 including a 10×10 array 31 of trap structures, arranged as ten parallel strings 30A-30J of trap structures arranged between ports 32, 38 for introduction of cell growth medium and oil, with channel segments 34A-34J, 36A-36J arranged between the strings 30A-30J of trap structures and the ports 32, 38. FIG. 5B is a magnified view of a first string 30A (or linear group) of ten traps 10A-1 to 10A-10 each including a split wall Pachinko-type trap structure 20A-1 to 20A-10 including a crescent-shaped split wall forming a cell receiving compartment. Alignment and/or mounting features 42 may optionally be provided. FIG. 5C is a further magnified view of a single cell trap 10A-1 of FIGS. 5A and 5B, showing a crescent-shaped split wall Pachinko-type trap structure 20A-1 arranged within a ring-shaped intermediate microchannel 14A-1 disposed between an upstream feed channel segment 34A and a downstream channel segment 13A-1. In certain embodiments, each channel segment 34A-34J, 36A-36J shown in FIG. 5A, as well as downstream channel segments (e.g., 13A-1 shown in FIG. 5C) may include a width ($W_c$) of about 100 microns, each circular ring-shaped intermediate channel segment (e.g., channel segment 14A-1 shown in FIG. 5C) may include a radius $R_W$ of about 120 microns, and each cell trap structure (e.g., split wall Pachinko-type trap structure 20A-1 shown in FIG. 5C) may include a width $W_T$ of about 18 microns between upstream ends of split walls forming the trap structure. Multiple (e.g., ten) wells and trap structures may be sequentially arranged downstream of each upstream feed channel segment 34A-34J.

Figure 6A:
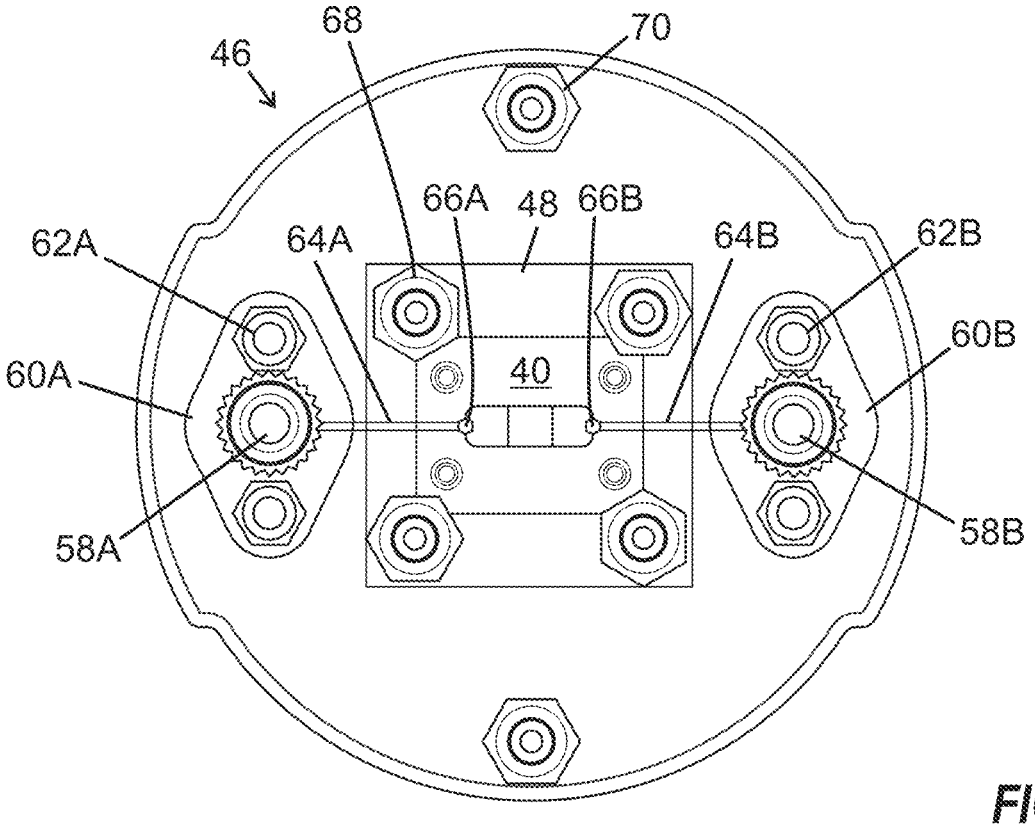
FIG. 6A is a top plan view illustration of an assembled microfluidic chip interface device for cell loading of a 10×10 array of microwells.
Figure 6B:
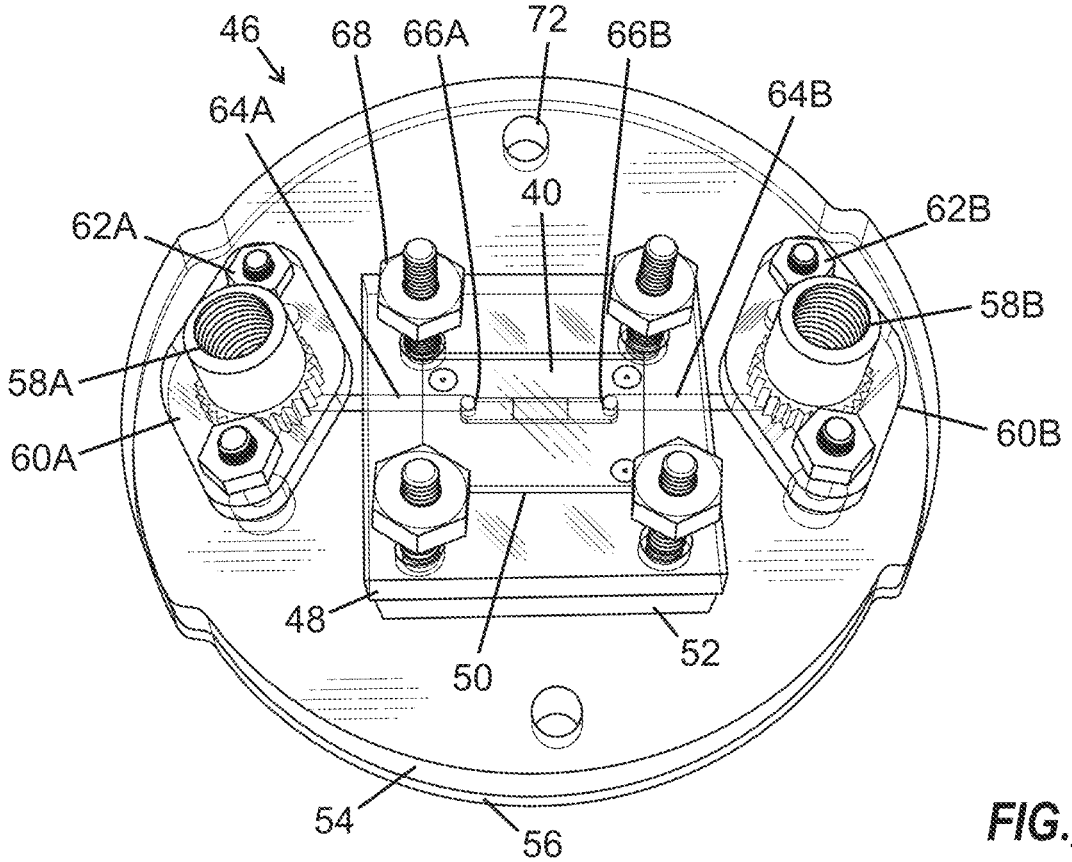
FIG. 6B is an upper perspective view illustration of an assembled microfluidic chip interface device according to the design of FIG. 6A.

Following a loading step, the microfluidic chip 40 can be kept in a cell culture incubator for certain amounts of time to allow for cell adhesion and to allow cells to return to normal function after trapping. Preferably, the microfluidic chip 40 is compatible with both adherent and suspension cell types. If suspension cells are used, then an incubation step may not be necessary and measurement of functional characteristics of cells may be performed immediately after trapping. After incubation, the top substrate part of a microfluidic chip may be replaced with a substrate containing a matching array of wells with sensor(s) to make an assay chip. In certain embodiments, the microfluidic chip 40 of FIG. 5A may be assembled into a chip interface device 46 shown in FIGS. 6A and 6B, including fluidic inlet and outlet ports.

58A, 58B to allow easy connections with tubing while keeping the top and bottom parts of the microfluidic chip 40 in contact. The chip interface device 46 includes generally circular body layers 54, 56 (fastened together with fasteners 70 extending through holes 72), with central portions of the body layers 54, 56 being arranged to receive an intermediate frame member 52 (which defines a recess 50 receiving the microfluidic chip 40) and an overlying cover block 48 arranged to overlie the microfluidic chip 40. Fasteners 68, which may include (but are not limited to) screws and nuts, compress the cover block 48 and the frame member 52 relative to the body layers 54, 56. Channel segments 64A, 64B are defined between the body layers 54, 56, and extend between the fluidic inlet and outlet ports 58A, 58B and vias 66A, 66B that are registered with ports (not shown) of the microfluidic chip 40. The fluidic inlet and outlet ports 58A, 58B and associated flanges 60A, 60B are affixed to the body layers 54, 56 with fasteners 62A, 62B. Experiments performed by the inventors with this design have demonstrated that the disassembly of the chip interface device 46 and assembly of the microfluidic chip 40 is simple to perform and takes three to four minutes. In operation of the chip interface device 46, fluids may be supplied to the fluidic inlet port 58A and conveyed by the channel segment 64A and via 66A to be distributed among an array of trap structures (as shown in FIG. 5A-5C) of the microfluidic chip 40, with excess fluid (including untrapped cells in certain instances) being permitted to exit the microfluidic chip 40 through another via 66B, channel segment 64B, and fluidic outlet port 58B. Different fluids may be supplied to the fluidic inlet port 58A in a sequential fashion using one or more upstream valves (not shown).

In certain embodiments, a microfluidic assay chip can be affixed to a base that provides a media input port, an oil input port, and an output port.

Figure 7A:
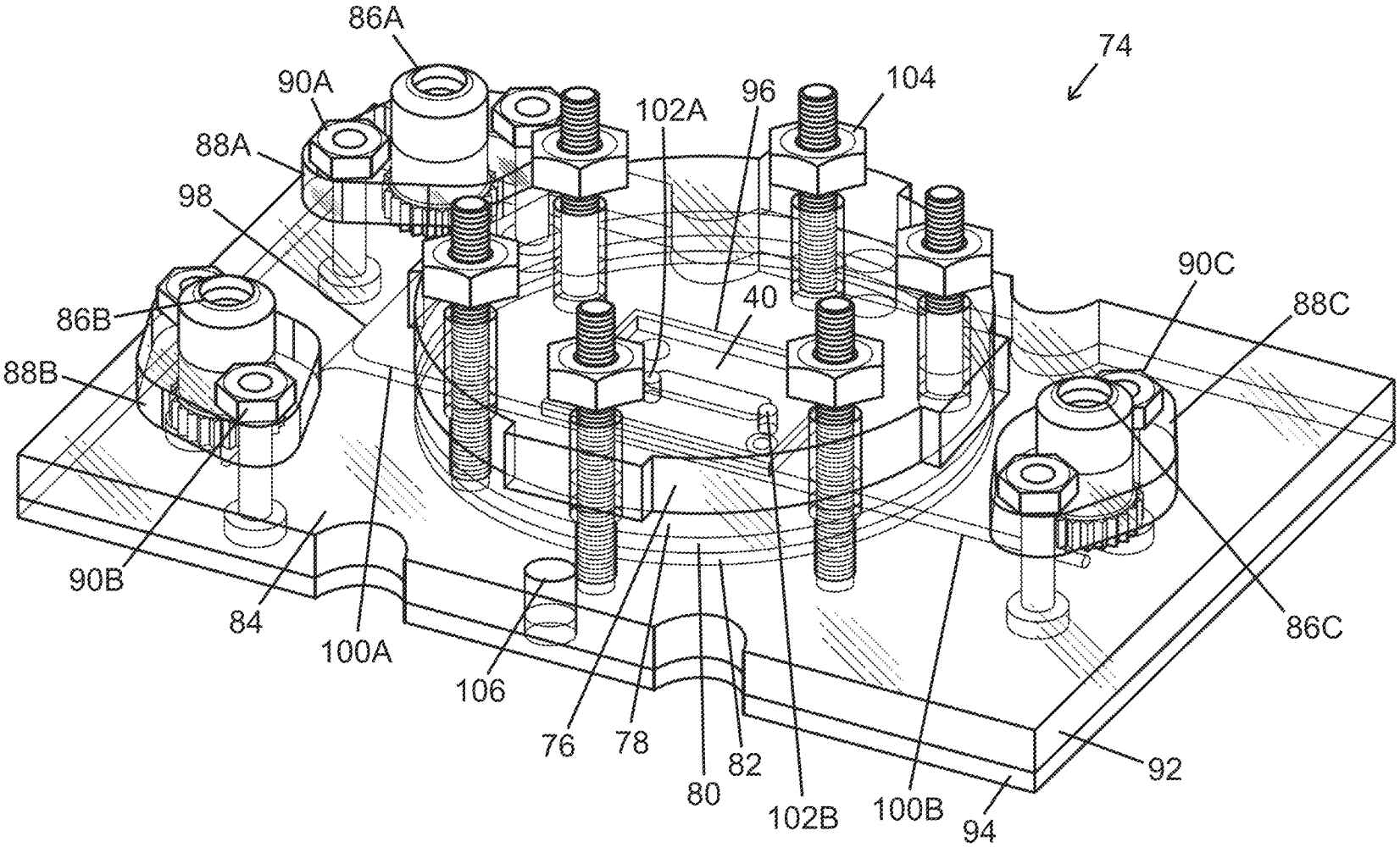
FIG. 7A is an upper perspective view illustration of an assembled microfluidic chip interface device according to another embodiment, arranged to receive a microfluidic chip including a 10×10 array of microwells, and having a base providing a media input port, an oil input port, and an output port.
Figure 7B:
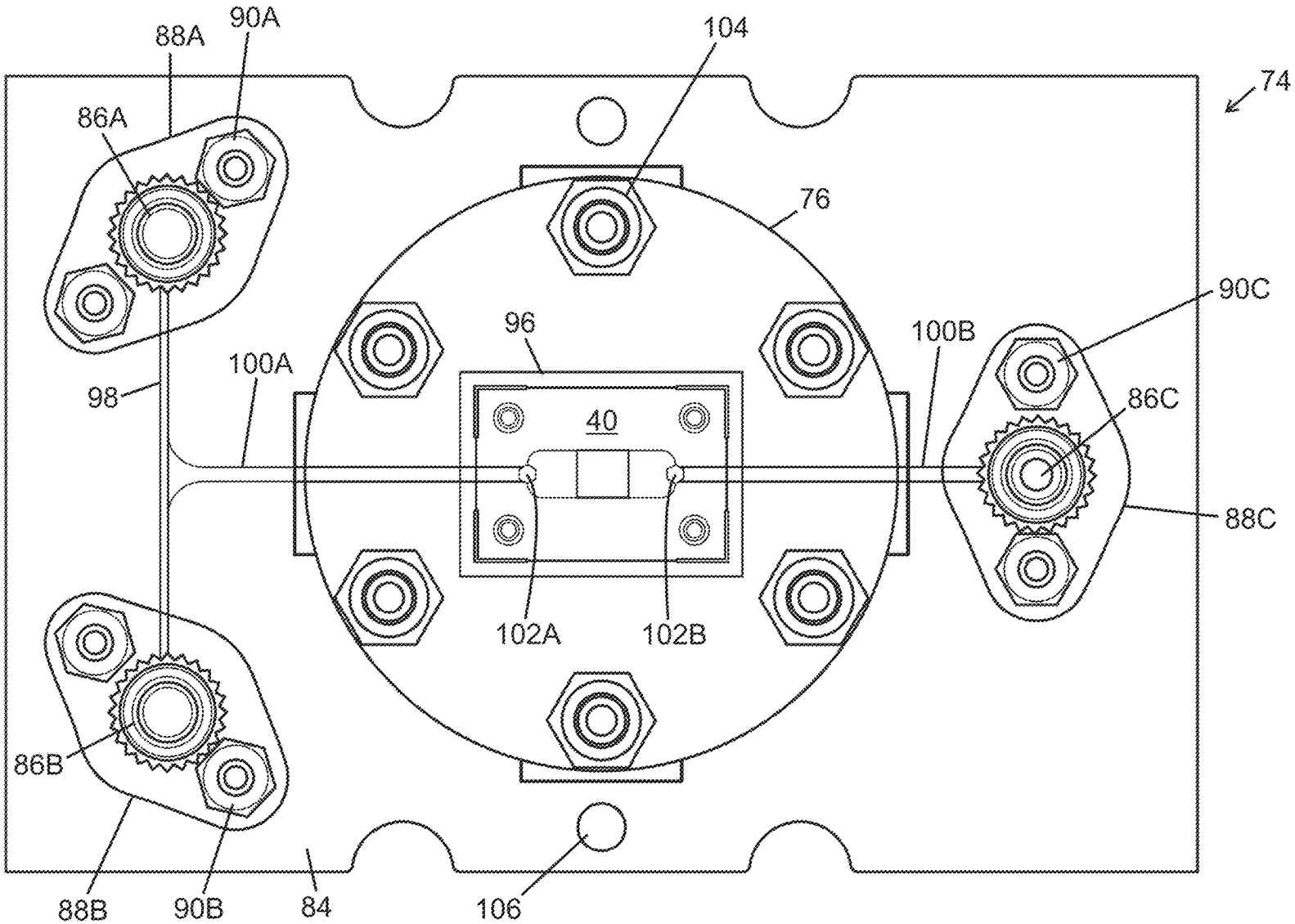
FIG. 7B is a top plan view illustration of the microfluidic chip and base of FIG. 7A.

FIGS. 7A and 7B illustrate an assembled microfluidic chip interface device 74 arranged to receive a microfluidic chip 40 including a 10×10 array of microwells, and having base layers 92, 94 providing a media input port 86A, an oil input port 86B, and a fluidic output port 86C. The microfluidic chip interface device 74 includes a generally circular cover block 76 overlying frame members 78, 80, 82, wherein at least one of the frame members 78, 80, 82 define a recess 96 arranged to receive the microfluidic chip 40. The base layers 92, 94 are generally rectangular in shape and extend laterally beyond the cover block 76, with the cover block 76 being arranged above an upper surface 84 of upper base layer 92 and affixed to the base layers 92, 94 with fasteners 104. Channel segments 98, 100A, 100B are defined between the base layers 92, 94, and extend between media input port 86A, oil input port 86B and fluidic outlet port 86C, with two channel segments 100A, 100B terminating at vias 102A, 102B that are registered with ports (not shown) of the microfluidic chip 40. Each port 86A-86C includes an associated flange 88A-88C that is affixed to the base layers 92, 94 with fasteners 90A-90C. Holes 106 defined through the base layers 92, 94 may be arranged to receive one or more additional fasteners (not shown). In operation of the microfluidic chip interface device 74, fluids may be supplied through the media input port 86A and oil input port 86B and conveyed by the channel segments 98, 100A and via 102A to be received by a microfluidic chip 40 and distributed among an array of trap structures (as shown in FIG. 5A-5C), with excess fluid (including untrapped cells in certain instances) being permitted to exit the microfluidic chip 40 and the microfluidic chip interface device 74 through another via 102B, channel segment 100B, and fluidic outlet port 86C.

Figure 8:
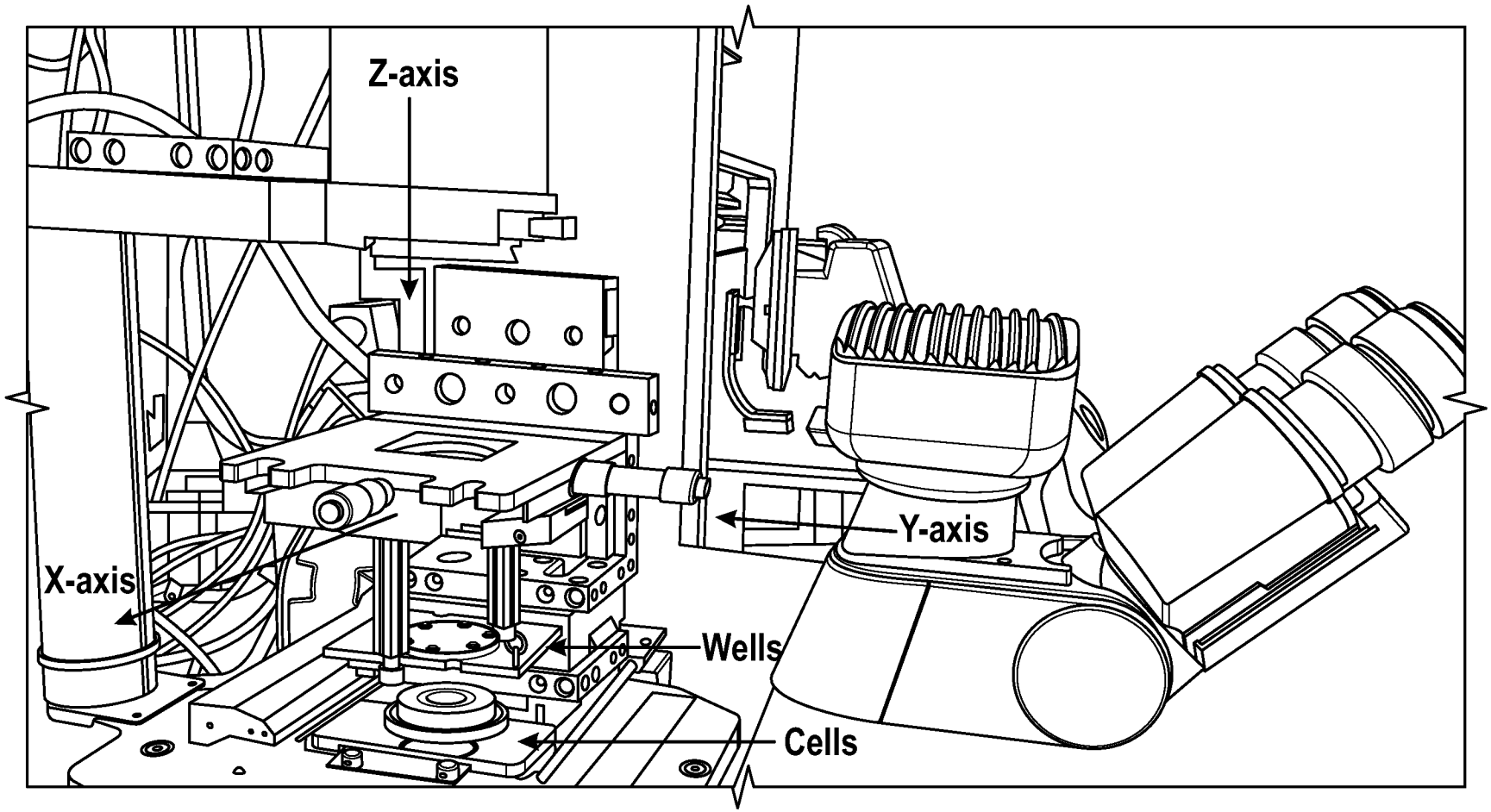
FIG. 8 illustrates a microscope setup for aligning bottom and top parts of a microfluidic chip, and for receiving a microfluidic chip interface device.

In certain embodiments, the bottom substrate part (defining wells) and the top substrate part (defining microchannels with split wall Pachinko-type trap structures) of a microfluidic device may be aligned with one another prior to contact. In certain embodiments, a relatively simple setup containing an XYZ translation stage and a rotational stage can be used to perform this alignment task. The setup can be mounted on an inverted microscope for visual feedback during the alignment step. A first illustration of a microscope setup for aligning top and bottom parts of a microfluidic chip is provided in FIG. 8. In another implementation, microfabricated features in the shape of cones, posts or similar objects may be used for self-alignment of the top and bottom part of the chip.

Figure 9:
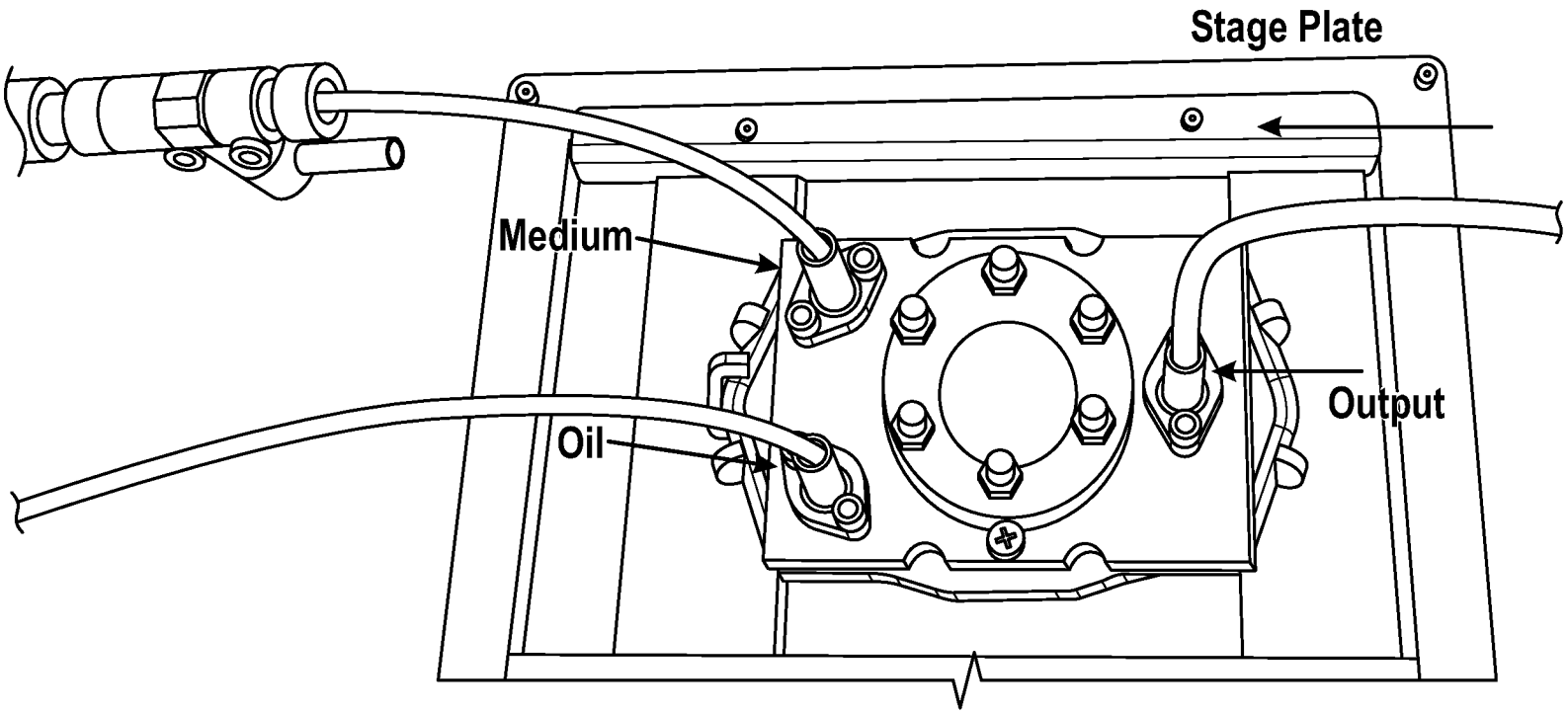
FIG. 9 illustrates a portion of the setup of FIG. 8, with a microfluidic chip interface device received within a fixture and with tubing connected to the microfluidic chip interface device.

Once a microfluidic chip has been assembled, it may be received within a microfluidic chip interface device that is configured to be mounted to a fixture of a microscope stage. One such fixture is shown in an empty state at center-left in FIG. 8. Once a microfluidic chip interface device is received within a fixture, fluidic connections may be made to the microfluidic chip interface device to permit fluids to be supplied to and received from a microfluidic device contained therein. FIG. 9 shows a portion of the setup of FIG. 8, with a microfluidic chip interface device according to the design of FIGS. 7A and 7B received within the fixture portion of FIG. 8, and tubing connected to the microfluidic chip interface device. In operation, oil is introduced through an oil input port (e.g., oil input port 86B shown in FIGS. 7A and 7B) to displace cell growth medium on the outside of wells within a microfluidic chip (e.g., the microfluidic chip 40 shown in FIG. 5A). In certain embodiments, a syringe may be used to introduce the oil and control its flow rate. In other embodiments, an automated syringe pump, peristaltic pump, or similar device may be used to control the flow rate of oil for higher accuracy and displacement speed. Experiments showed that it takes about 1-3 seconds to replace medium with oil and vice versa. This time can be reduced when using automated fluidic manipulation platforms. The assay can be started immediately after introduction of oil or several seconds before oil introduction to the microfluidic chip, if baseline sensor readouts need to be established. An assay may be performed by taking a series of fluorescence images of a sensor array arranged in or on the microfluidic chip and determining changes in sensor intensity, spectral characteristics, fluorescence decay lifetime or a combination thereof as a readout. The changes in sensor characteristics correspond to alterations in concentration of the analyte(s) of interest. Virtually any inverted or upright microscope equipped with fluorescence or absorbance imaging modality can be used for this purpose.

In certain embodiments, sensors arranged in, on, or in sensory communication with, a microfluidic chip and/or a microfluidic chip interface device may be based on Raman scattering, phosphorescence, surface-plasmon resonance, resonance energy transfer, or any other phenomena or a combination thereof.

In certain embodiments, a sensor readout is performed by averaging a signal emanating from a sensor area whereby an array of regions of interest on a microfluidic chip is generated that match the sensor locations on the acquired images. The sensor emission intensity data may be extracted and analyzed as a function of time to reveal temporal dynamics of the sensor response, which in turn represents the kinetics of the corresponding analytes in a microwell. In certain embodiments, image processing, data extraction, and analysis can be done in real time, as the data is being produced. Alternatively, for more detailed and complex data analysis, in certain embodiments these steps may be performed after an entire dataset has been acquired.

Figure 10A:
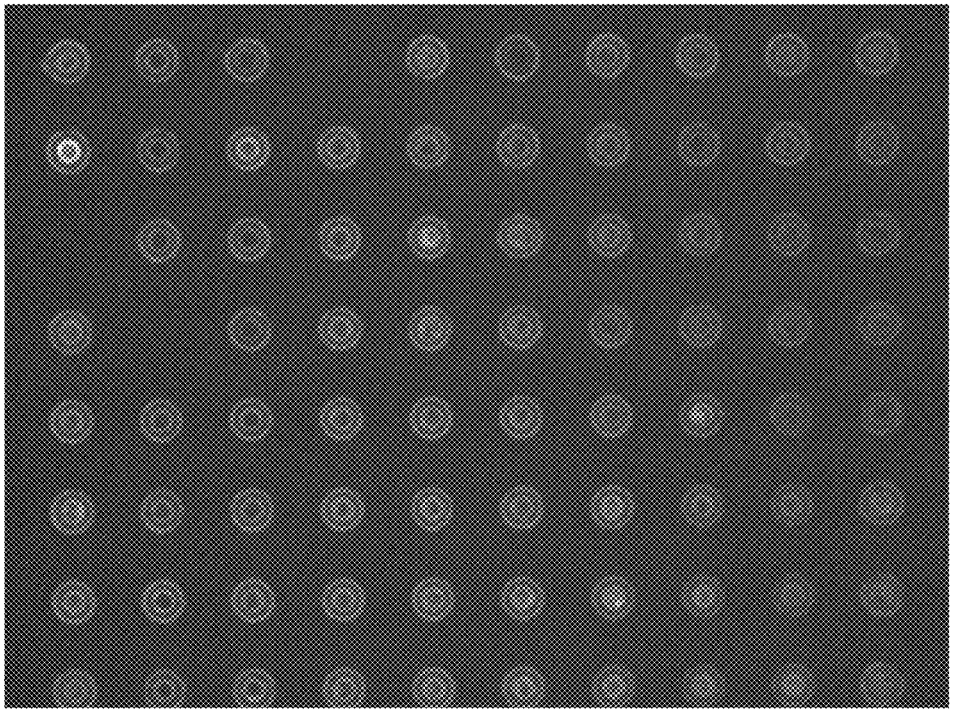
FIG. 10A is a fluorescence image of an oxygen sensor array of an assembled microfluidic device.
Figure 10B:
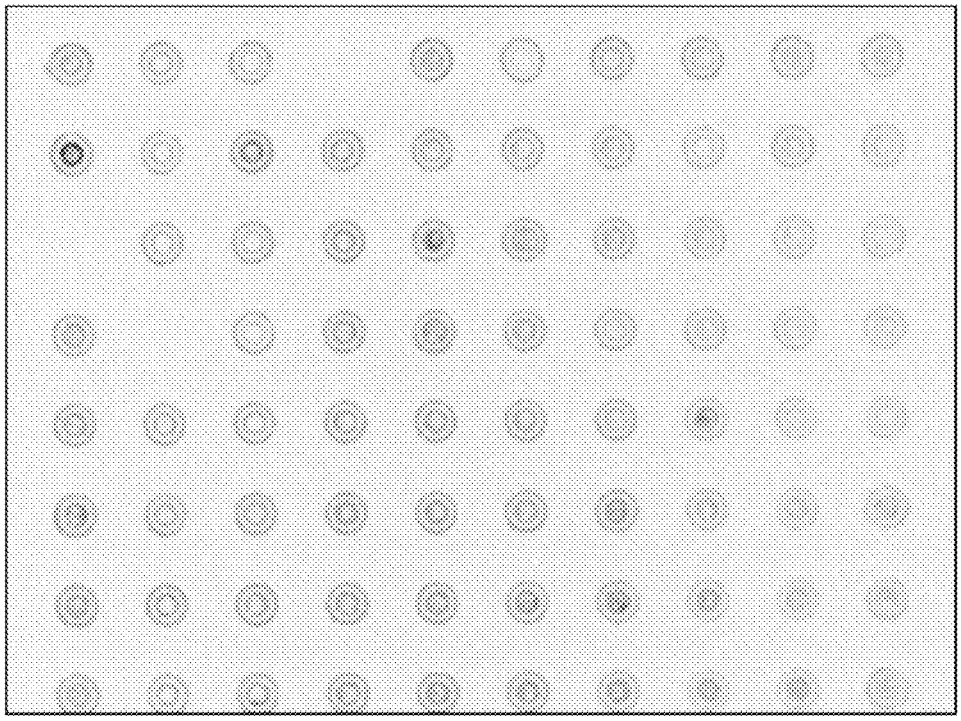
FIG. 10B is a color inverted version of the fluorescence image of FIG. 10A.

FIG. 10A is a fluorescence image of an oxygen sensor array of an assembled microfluidic chip, and FIG. 10B is a color inverted version of the fluorescence image of FIG. 10A. Such figures show responses of the oxygen sensor array to changes in oxygen concentration due to respiration of individual cells on the microfluidic chip. Imaging of the oxygen sensor array permits oxygen concentration to be determined for each cell or group of cellular material trapped within a microfluidic chip.

Figure 11:
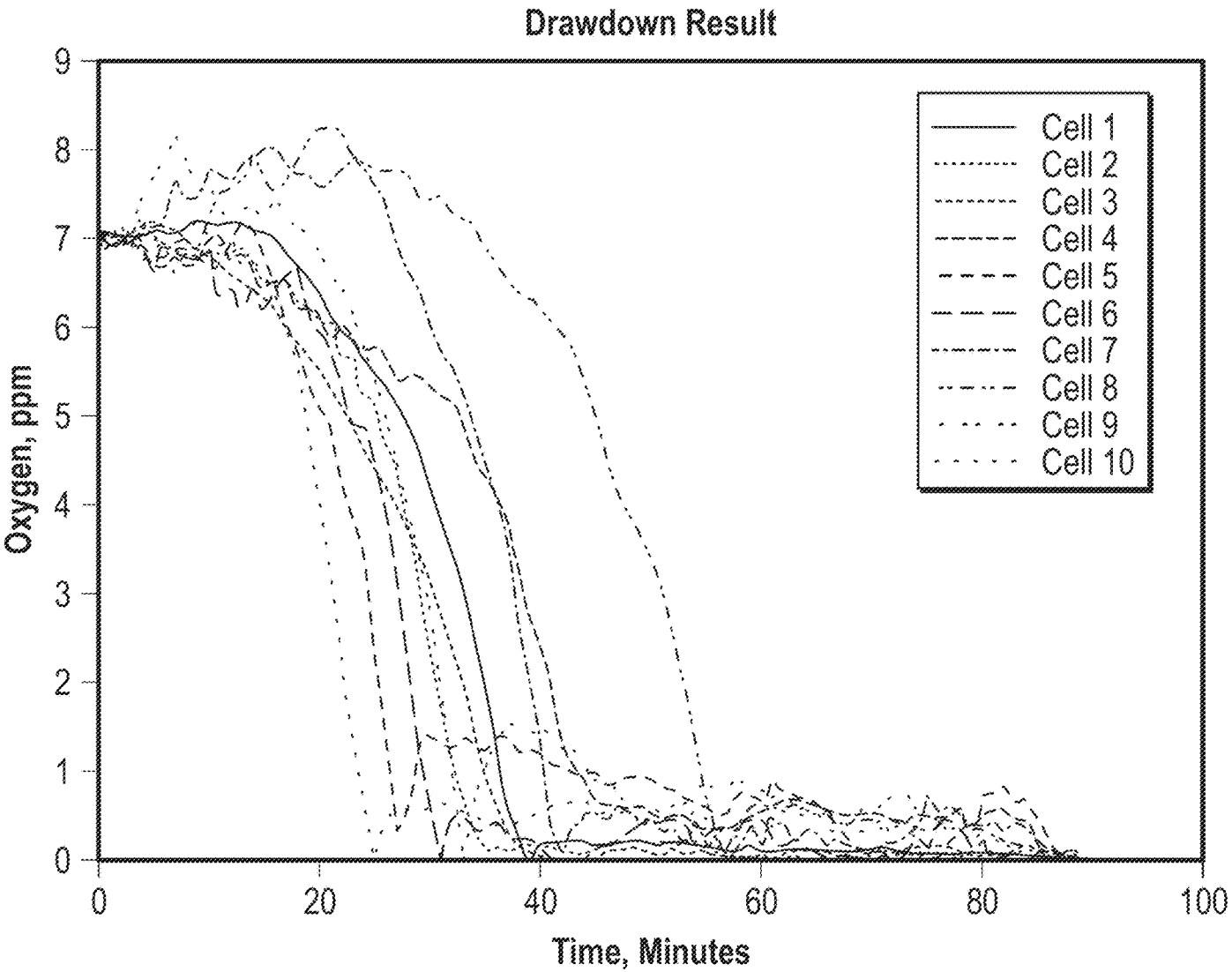
FIG. 11 is a plot of sensor intensity response (oxygen consumption with respect to time) for cells obtained during an assay using an assembled microfluidic device, wherein each curve represents oxygen consumption of a different individual cell.

FIG. 11 is a plot of sensor intensity response embodying a drawdown result (i.e., oxygen consumption in ppm with respect to time in minutes) for ten cells obtained during an assay using an assembled microfluidic chip, wherein each curve represents oxygen consumption of a different individual cell. As of the effective date of this application, the inventors have demonstrated assay yields of up to 70% (oxygen consumption curves of 70 individual cells per assay).

After an assay has been run, oil contained in a microfluidic chip may be replaced with another growth medium using the same steps as described above for the introduction of oil. The newly introduced medium may differ from a medium that was previously present within a microfluidic chip, such as by containing different types of perturbagens, by being conditioned or buffered at a different pH, by having a different temperature, etc. Due to a rapid fluid replacement step (1-3 seconds) achievable in preferred embodiments, the time factor is negligible.

A broad variety of different media or solutions for different types of in situ or downstream analyses can be used. In certain embodiments, cell lysis buffer mixed with a one-step RT-qPCR mixture may be introduced to first release the cellular contents followed by on-chip RT-qPCR analysis of the same cells while the cells remain in the original analysis wells. Alternatively or additionally, other reagents may be introduced into the analysis wells for other experiments such as RNA analysis, DNA analysis, protein analysis, etc., for on-chip analysis of the same cells in the original analysis wells. To this end, in certain embodiments, a microfluidic chip as disclosed herein may be placed in a thermocycler to attain required temperature points for the reaction. In certain embodiments, cells may be retrieved from a microfluidic chip utilizing laser microdissection and catapulting, thermal dissociation, shear force, or similar mechanisms (or combinations thereof) for downstream (off-chip) analysis of the cells. In certain embodiments, cells retrieved from a microfluidic chip may be used for further culturing and growing clonal populations.

In certain embodiments, a microfluidic chip and an associated microfluidic chip interface device may be scaled up to contain larger numbers of wells (e.g., on the order of 1,000 wells, 10,000 wells, 100,000 wells, or more) without introducing major changes to the basic design for microwells or associated microfluidic channels.

In certain embodiments, a microfluidic device may be implemented in a manner that enables monitoring of cellular function, including but not limited to transmembrane fluxes of analytes in cell populations. In certain embodiments, the size of the wells may be increased to a millimeter scale or larger while increasing the number of traps per well to several hundreds or thousands. Such millimeter scale wells can be loaded directly with a pipette by dispensing several microliters of cell suspension into the well or by other suitable means including pumps, etc.

In certain embodiments, extracellular sensors may be combined with commercially available intracellular sensors for multiplexed sensing. In certain embodiments, a bottom substrate part can be made 170-200 μm thick to render it compatible with high resolution imaging using short working distance, high numerical aperture objective lenses.

In certain embodiments, a microfluidic chip and/or an associated microfluidic chip interface device may be modified to enable recirculation of suspended cells to increase cell occupancy in wells. Such modification would also enable working with small clinical samples obtained using either small needle aspirates or bite biopsies that may contain only several hundred to several thousands of cells.

In certain embodiments, a microfluidic chip and/or an associated microfluidic chip interface device may be made with integrated elements (e.g., heating and/or cooling elements) to control temperature for long term studies. Such a chip and/or device may be easily modified to enable continuous perfusion with cell growth media for both long-term studies and response dynamics studies.

Figure 12A:
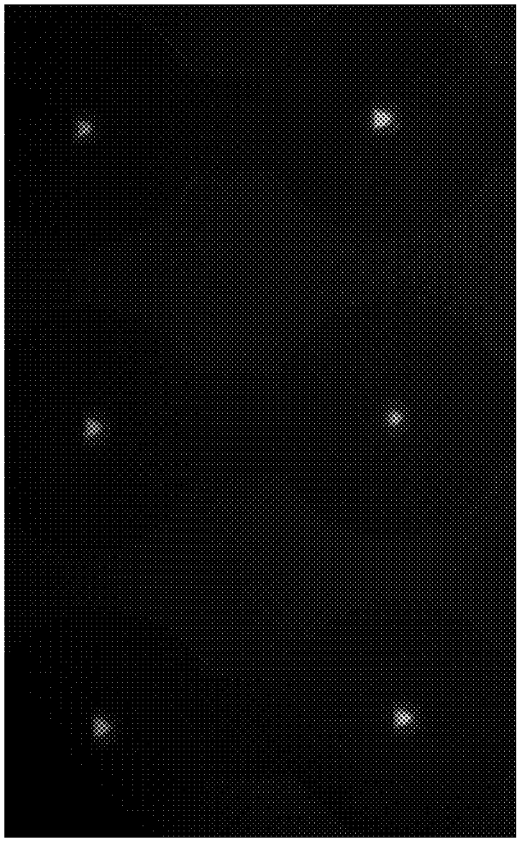
FIG. 12A is a photograph of human lung adenocarcinoma epithelial cells stained with CalceinAM and trapped in multiple split-wall, Pachinko-type trap structures, with the cells appearing as lit semi-circles.
Figure 12B:
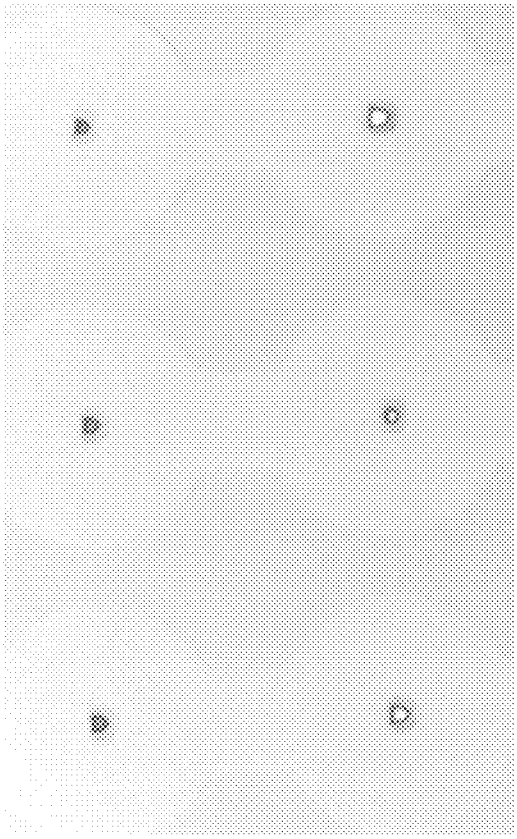
FIG. 12B is a color transformed (solarized) and color inverted version of the photograph of FIG. 12A, with the split-wall, Pachinko-type trap structures appearing dark colored and containing illuminated cells, with faint outlines of circular channels surrounding the split-wall, Pachinko-type trap structures.

A series of experiments were conducted using a microfluidic chip consistent with the design of FIG. 5A utilizing human lung adenocarcinoma epithelial cells (A549 cell line). The cells were stained with CalceinAM [$C_{46}H_{46}N_2O_{23}$] (Thermo Fisher Scientific, Waltham, Mass., US), which is a cell-permeant dye that can be used to determine cell viability. In live cells, CalceinAM is converted to a green-fluorescent calcein after acetoxymethyl ester hydrolysis by intracellular esterases. Reproducible cell loading rates of traps of the microfluidic chip was observed, as evidenced by FIGS. 12A and 12B. FIG. 12A is a photograph showing the CalceinAM-stained A549 cells trapped in multiple (six) split wall Pachinko type trap structures, with the cells appearing as lit semicircles. FIG. 12B is a color transformed (solarized) and color inverted version of the photograph of FIG. 12A, with the split wall Pachinko-type trap structures appearing dark colored and containing illuminated A549 cells, with faint outlines of circular channels surrounding the split wall Pachinko-type trap structures.

Figure 13:
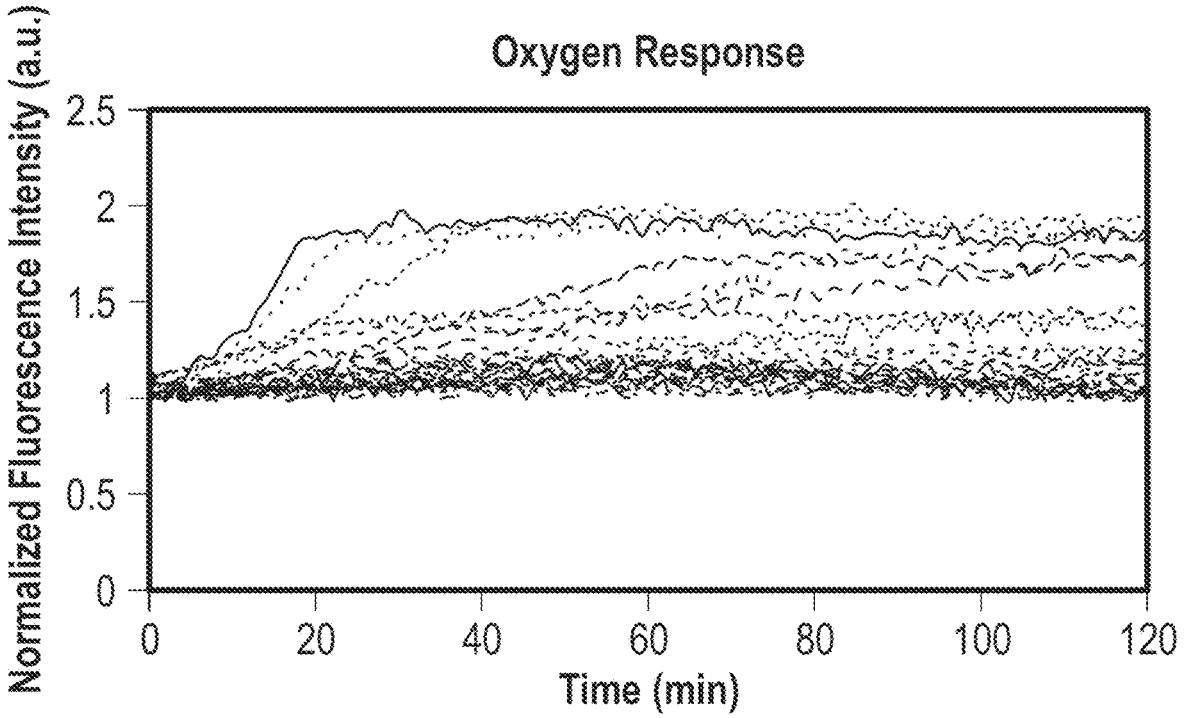
FIG. 13 is a plot of normalized fluorescence intensity (a.u.) versus time (in minutes) representing oxygen consumption kinetics (oxygen response) obtained with a multiple-well device using mineral oil as a sealing media, wherein each curve represents the response of one single well, and the intensity data were normalized to the intensity value at the beginning of the experiment.
Figure 14:
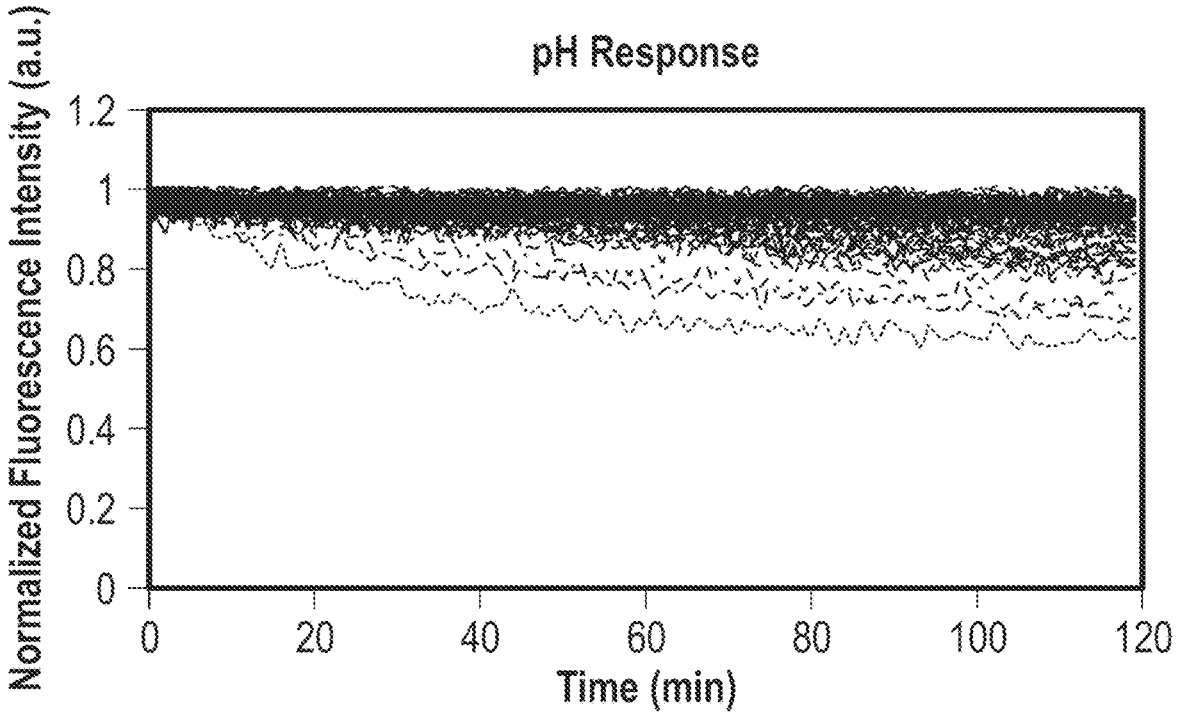
FIG. 14 is a plot of normalized fluorescence intensity (a.u.) versus time (in minutes) representing extracellular acidification kinetics (pH response) using the same cells as characterized in FIG. 13.

Additionally, a series of drawdown experiments with A549 cells was performed to determine their oxygen consumption and extracellular acidification rates. Such drawdown experiments were successfully and consistently performed. FIG. 13 is a plot of normalized fluorescence intensity (a.u.) versus time (in minutes) representing oxygen consumption kinetics (oxygen response) of A549 cells obtained with a multiple-well device using mineral oil as a sealing media, wherein each curve represents the response of one single well, and the intensity data were normalized to the intensity value at the beginning of the experiment. FIG. 14 is a plot of normalized fluorescence intensity (a.u.) versus time (in minutes) representing extracellular acidification kinetics (pH response) using the same cells as characterized in FIG. 13. Relative consistency in data within each of FIGS. 13 and 14 demonstrates the robustness of the microfluidic chip platform and the flexibility of the platform to work with different cell types.

Upon reading the foregoing description in light of the accompanying drawing figures, those skilled in the art will understand the concepts of the disclosure and will recognize applications of these concepts not particularly addressed herein. Those skilled in the art will recognize improvements and modifications to the preferred embodiments of the present disclosure. All such improvements and modifications are considered within the scope of the concepts disclosed herein and the claims that follow.

What is claimed is:

1. A microfluidic device comprising:

a first substrate defining at least one microfluidic channel and a plurality of ring structures that form sidewalls of a plurality of microwells, wherein each ring structure of the plurality of ring structures comprises a first height; and a second substrate defining a plurality of split-walled cell trap structures, wherein each split-walled cell trap structure of the plurality of split-walled cell trap structures comprises a second height that is greater than the first height, wherein the plurality of split-walled cell trap structures is registered with and disposed within the plurality of ring structures that form sidewalls of the plurality of microwells, and wherein a difference in height between each ring structure and each corresponding split-walled trap structure registered therewith defines a gap between the first substrate and the second substrate along a lip of each microwell of the plurality of microwells.

2. The microfluidic device of claim 1, wherein the gap between the first substrate and the second substrate along the lip of each microwell of the plurality of microwells has a height of about 2 μm.

3. The microfluidic device of claim 1, wherein each cell trap structure of the plurality of split-walled cell trap structures comprises an open upstream end sized to receive at least one cell, and comprises a downstream opening configured to inhibit passage of the at least one cell while permitting passage of an aqueous medium.

4. The microfluidic device of claim 3, wherein the at least one microfluidic channel comprises an increased lateral dimension proximate to each microwell of the plurality of microwells.

5. The microfluidic device of claim 1, further comprising a media inlet port, a secondary fluid inlet port, and an outlet port in fluid communication with the at least one microfluidic channel.

6. The microfluidic device of claim 1, wherein the at least one microfluidic channel comprises a plurality of microfluidic channels arranged in parallel, the plurality of microwells includes multiple groups of microwells, and each microfluidic channel of the plurality of microfluidic channels interconnects a different group of microwells of the multiple groups of microwells.

7. The microfluidic device of claim 3, wherein the open upstream end defines an opening having a width in a range of from about 10 microns to about 30 microns.

8. The microfluidic device of claim 1, further comprising a plurality of sensors in sensory communication with the plurality of microwells.

9. The microfluidic device of claim 1, further comprising at least one heating or cooling element configured to control temperature of the microfluidic device.

10. The microfluidic device of claim 1, wherein each split-walled trap structure extends from the first substrate to contact a bottom of the second substrate.

11. The microfluidic device of claim 1, wherein the gap between the first substrate and the second substrate along a lip of each microwell of the plurality of microwells is configured, when an aqueous solution is present within the microwell, to promote surface tension sufficient to prevent a non-polar fluid from entering the microwell.

12. A method for performing an assay using live cells, in at least one of isolation, small populations, multicellular clusters, or small tissue samples, the method comprising:

flowing cells, small populations of cells, multi-cellular clusters, or small tissue samples and flowing a first aqueous medium into a microfluidic device comprising a microfluidic channel interconnecting a plurality of microwells, wherein each microwell of the plurality of microwells is defined by a ring structure, defined in a first substrate, that forms sidewalls of the microwell and that contains a split-walled cell trap structure defined in a second substrate, registered with the ring structure, and configured to trap at least one cell, thereby causing each cell trap structure to trap at least one cell, wherein each ring structure comprises a first height, wherein each split-walled cell trap structure comprises a second height that is greater than the first height, and wherein a difference in height between each ring structure and each corresponding split-walled trap structure registered therewith defines a gap between the first substrate and the second substrate along a lip of each microwell of the plurality of microwells; and flowing a non-polar fluid with low permeability for analytes of interest through the microfluidic channel, without entering the plurality of microwells, to flush from the microfluidic channel a portion of the first aqueous medium residing outside the microwells, while retaining another portion of the first aqueous medium as well as the at least one cell within each microwell of the plurality of microwells.

13. The method of claim 12, further comprising flowing a second aqueous medium through the microfluidic channel to flush the non-polar fluid from the plurality of microwells and to flush the other portion of the first aqueous medium from each cell trap structure while retaining the at least one cell within each cell trap structure.

14. The method of claim 12, further comprising incubating the at least one cell within each microwell of the plurality of microwells.

15. The method of claim 12, further comprising sensing concentration of at least one analyte for the at least one cell trapped in each cell trap structure.

16. The method of claim 12, further comprising analyzing cellular function of the at least one cell trapped in each cell trap structure.

17. The method of claim 12, wherein the at least one cell trapped in each cell trap structure comprises a multi-cell cluster or tissue sample.

18. The method of claim 12, further comprising fabricating the microfluidic device by contacting a first substrate defining at least one microfluidic channel and a plurality of ring structures that form sidewalls of the plurality of microwells with a second substrate defining a plurality of split-walled cell trap structures, wherein the plurality of split-walled cell trap structures is registered with and disposed within the plurality of ring structures that form sidewalls of the plurality of microwells.

19. The method of claim 12, further comprising introducing cell lysis buffer and one-step RT-qPCR mixture to each microwell of the plurality of microwells to release cellular contents of cells within the plurality of microwells, and performing RT-qPCR analysis of cells within the microfluidic device while the cells remain in the plurality of microwells.

20. The method of claim 12, further comprising flowing one or more reagents into each microwell of the plurality of microwells and analyzing cells within the microfluidic device while the cells remain in the plurality of microwells.

* * * * *